US005152217A

United States Patent [19]

Farb et al.

[11] Patent Number: 5,152,217

[45] Date of Patent: Oct. 6, 1992

[54] PRINTER HAVING IMPROVED HAMMERBANK AIRFLOW

[75] Inventors: Norman E. Farb, Villa Park; Steven S. Hughes, Costa Mesa, both of Calif.

[73] Assignee: Printronix, Inc., Irvine, Calif.

[21] Appl. No.: 250,397

[22] Filed: Sep. 28, 1988

Related U.S. Application Data

[63] Continuation of Ser. No. 69,021, Jul. 1, 1987, abandoned.

[51] Int. Cl.[5] ..... B41J 2/245

[52] U.S. Cl. ..... 101/93.04; 400/323; 400/121; 400/157.2; 101/93.29

[58] Field of Search ..... 400/121, 124, 157.2, 400/320, 322, 323, 328, 341, 157.1, 352, 353, 354, 719; 101/93.04, 93.05, 93.09, 93.29, 93.48, 93.32, 93.33, 93.34

[56] References Cited

U.S. PATENT DOCUMENTS

| | | | |
|---|---|---|---|
| 3,086,457 | 4/1963 | Antonucci | 101/93.29 |
| 3,941,051 | 3/1976 | Barrus et al. | 101/94.04 |
| 3,983,806 | 10/1976 | Ishi | 101/93.34 |
| 4,033,255 | 7/1977 | Kleist et al. | 101/93.04 |
| 4,044,668 | 8/1977 | Barrus et al. | 400/124 |
| 4,225,250 | 9/1980 | Wagner et al. | 400/124 |
| 4,233,894 | 11/1980 | Barrus et al. | 101/93.04 |
| 4,258,623 | 3/1981 | Barrus et al. | 101/93.04 |
| 4,280,404 | 7/1981 | Barrus et al. | 101/93.03 |
| 4,373,440 | 2/1983 | Jezbera | 101/93.48 |
| 4,386,563 | 6/1983 | Farb | 101/93.04 |
| 4,423,675 | 1/1984 | Luo et al. | 101/93.29 |
| 4,438,692 | 3/1984 | Yanadori et al. | 101/93.04 |
| 4,462,705 | 7/1984 | Hayashi et al. | 101/93.04 |
| 4,527,469 | 7/1985 | Wolf et al. | 101/93.04 |
| 4,539,905 | 9/1985 | Zenner | 101/93.09 |
| 4,540,966 | 9/1985 | Zelkowitz | 101/93.29 |
| 4,572,685 | 2/1986 | Matsumoto et al. | 101/93.04 |
| 4,601,241 | 7/1986 | Fujiwara | 101/93.04 |
| 4,625,638 | 12/1986 | Fritz et al. | 101/93.04 |
| 4,669,051 | 10/1987 | Jezbera | 101/93.48 |

FOREIGN PATENT DOCUMENTS

| | | | |
|---|---|---|---|
| 181653 | 8/1986 | Japan | 400/157.2 |

OTHER PUBLICATIONS

D. W. Hanna et al., *IBM Technical Disclosure Bulletin*, vol. 24, No. 3, pp. 1702-1704, Aug. 1981, "Magnetic Compensation and Cooling Technique for a Stored Energy Print Actuator".

*Primary Examiner*—David A. Wiecking

*Attorney, Agent, or Firm*—Spensley Horn Jubas & Lubitz

[57] ABSTRACT

An improved hammerbank in a dot matrix line printer has two different sets of staggered apertures therein along the length thereof for drawing pressurized air at the outside of the hammerbank therein to provide turbulent, high velocity cooling air in the region below the magnetic coils of the magnetic hammer actuators. The cooling air is confined to passage over the magnetic coils by enlarged flanges on the coil bobbins which form an air dam. The air dam discourages escape of the cooling air through spaces between the hammer springs.

Magnetic interaction between adjacent magnetic hammer actuators is minimized due to the absence of common magnetic materials extending therebetween, except for the permanent magnets which hold the hammer springs in the retracted position. The permanent magnets are common to a plurality of the magnetic hammer actuators and by physically extending therebetween serve to prevent substantial leakage flux from occurring.

The hammerbank is mounted for reciprocating motion by a single, intergrally formed, hollow shaft which extends through the entire length of the hammerbank and beyond the opposite ends thereof.

The hammer springs are mounted by screws driven into endless screw holes which terminate at the cooling apertures within the hammerbank so as to accommodate relatively long screws and at the same time expel debris that might otherwise accumulate within the screw holes.

The upper portions of a cover assembly at the front of the hammerbank are held in fixed relation by magnetic clip assemblies mounted thereon and having permanent magnets attached thereto in a manner which permits precision grinding of the clip assemblies.

21 Claims, 9 Drawing Sheets

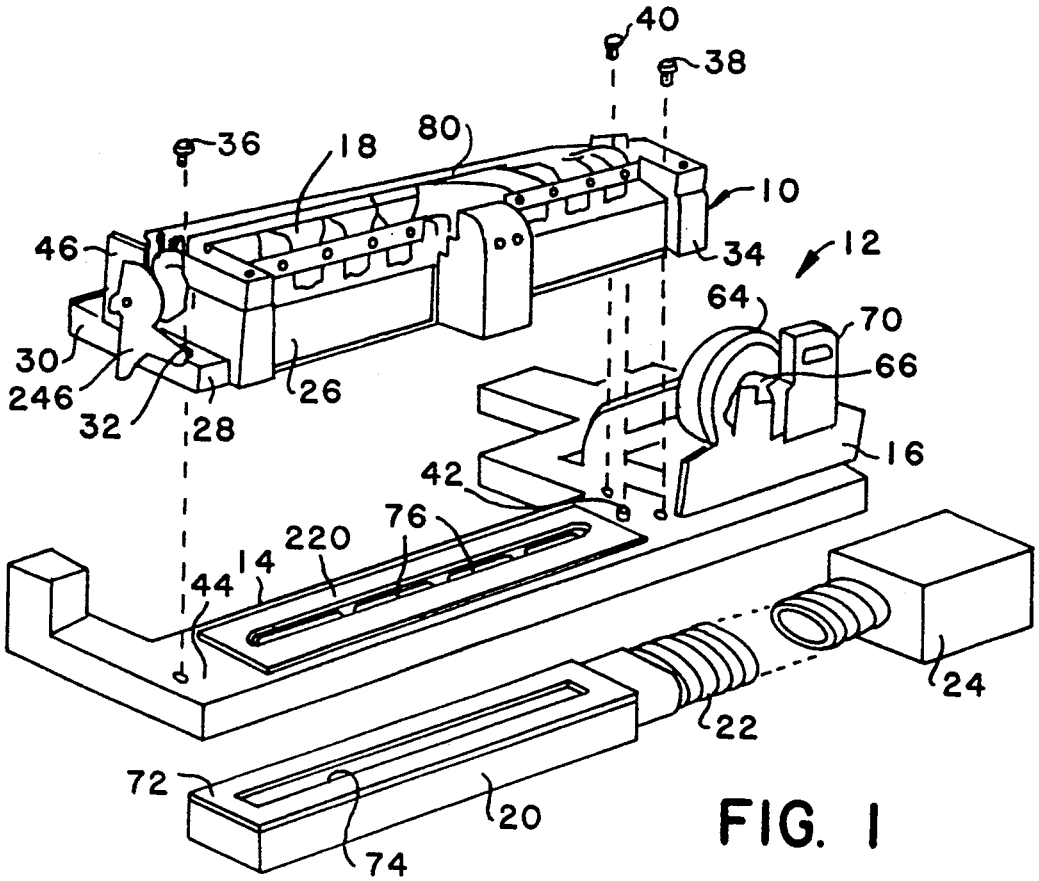
FIG. 1
FIG. 2
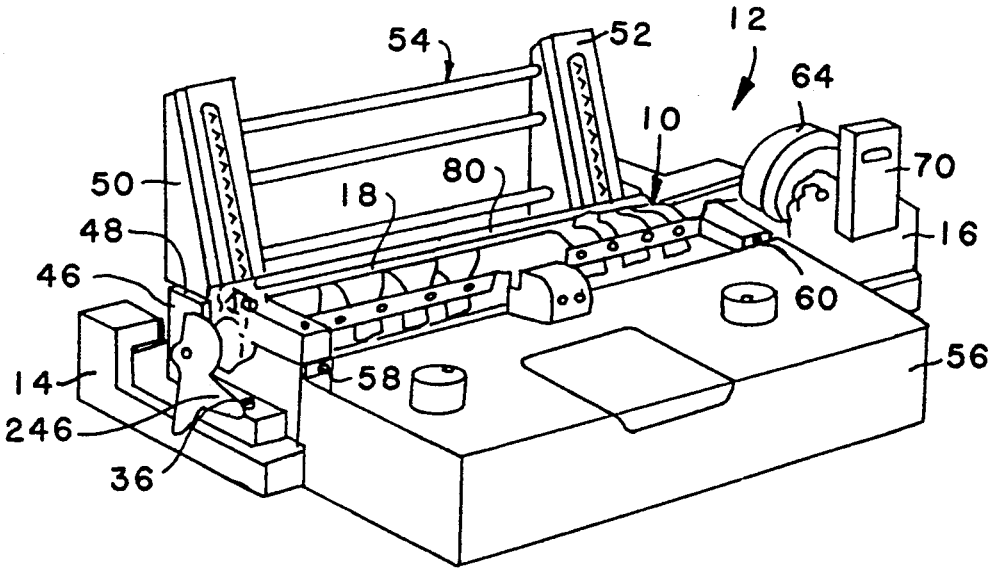

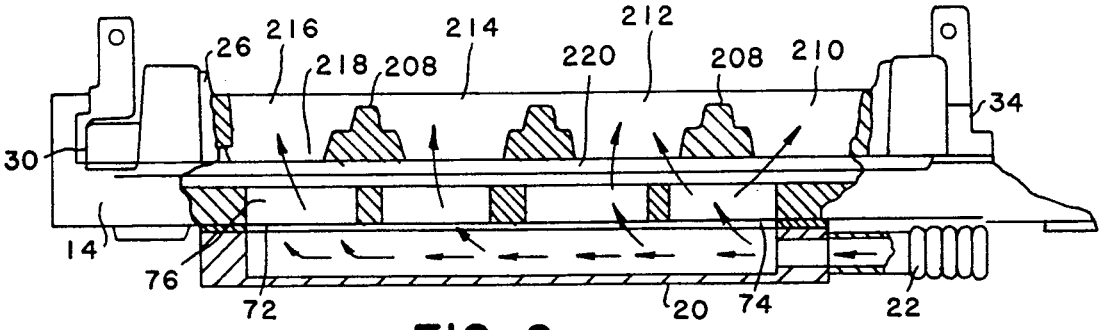
FIG. 6
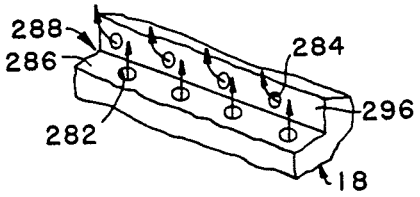
FIG. 14
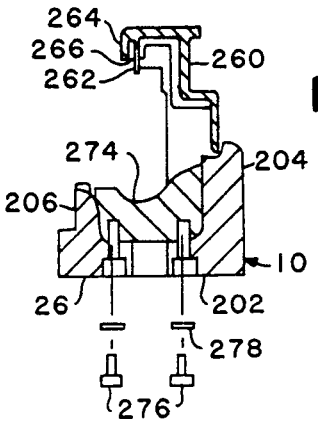
FIG. 15
FIG. 16
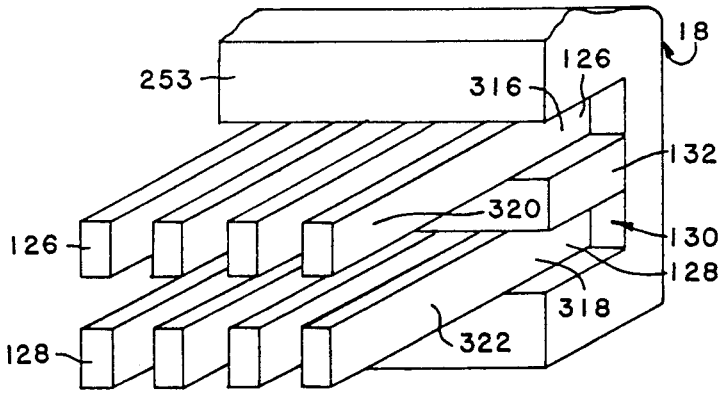
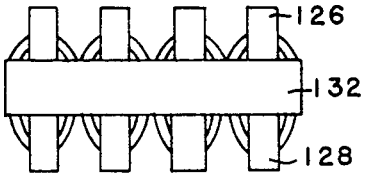
FIG. 17

PRINTER HAVING IMPROVED HAMMERBANK AIRFLOW

This is a continuation of co-pending application Ser. No. 69,021 filed on Jul. 1, 1987, now abandoned.

BACKGROUND OF THE INVENTION

1. Field of the Invention

The present invention relates to impact printers, and more particularly to dot matrix line printers in which an elongated hammerbank is driven in reciprocating fashion relative to a length of print paper while magnetic hammer actuators mounted along the length of the hammerbank in association with hammer springs are selectively actuated to release the hammer springs and thereby print dots on the length of print paper.

2. History of Prior Art

Printers are known in which an elongated hammerbank undergoes reciprocating, bi-directional motion relative to a length of print paper to effect the impact printing of dots. An example of such a printer is provided by U.S. Pat. No. 3,941,051 of Barrus et al., PRINTER SYSTEM, issued Mar. 2, 1976, which patent is commonly assigned with the present application.

The Barrus et al. patent describes a dot matrix line printer having an elongated hammerbank driven in reciprocating, bi-directional fashion by a cam drive assembly. A ribbon deck mounted within the printer adjacent the hammerbank disposes a length of ink ribbon between a plurality of hammer springs mounted in spaced-apart, parallel fashion along the length of the hammerbank and an adjacent platen. A length of print paper disposed between the length of ink ribbon and the platen is stepped through the print station defined by the space between the hammerbank and the platen by a tractor drive arrangement.

The printer described in the Barrus et al. patent performs printing in dot matrix fashion. As the hammerbank is reciprocated back and forth across the print paper, various ones of the hammer springs along the length of the hammerbank are released or fired from the spring-loaded retracted positions in which they are normally held, using associated magnetic hammer actuators. As each hammer spring is released or fired, an upper free end thereof which mounts a dot printing impact tip thereon flies forward out of the retracted position so that the dot printing impact tip impacts the length of ink ribbon against the print paper to print a dot. The hammer spring then rebounds into the retracted position. Each of the magnetic hammer actuators includes a permanent magnet coupled to the upper free end of an associated one of the hammer springs through a pole piece. The permanent magnet normally holds the hammer spring in the spring-loaded retracted position in readiness for release or firing. The magnetic hammer actuator also includes a magnetic coil surrounding the pole piece and operative, when momentarily energized, to overcome the effects of the permanent magnet and release the hammer spring to print a dot on the print paper.

In hammerbanks of the type described in the previously referred to U.S. Pat. No. 3,941,051 of Barrus et al., the various hammer springs are released or fired rapidly and repeatedly as the hammerbank moves back and forth across the length of print paper in reciprocating fashion. The repeated energizing of the magnetic coils causes them to quickly heat up, making it necessary that provision be made for cooling of the coils. One arrangement for cooling the coils is described in U.S. Pat. No. 4,033,255, of Kleist et al, PRINT HAMMER ACTUATOR FOR DOT MATRTIX PRINTERS, which patent issued Jul. 5, 1977 and is commonly assigned with the present application. The arrangement described in the Kleist et al. patent utilizes cooling fins mounted on top of the magnetic coils. The cooling fins absorb heat from the magnetic coils and readily release the heat to passing air which is blown over the fins under pressure. An alternative arrangement for providing coil cooling is described in U.S. Pat. No. 4,044,668 of Barrus et al., PRINT HAMMER MECHANISM, which patent issued Aug. 30, 1977 and is commonly assigned with the present application. In the Barrus et al. '668 patent, pressurized air is directed toward the rear of the hammerbank from which it enters the interior of the hammerbank through apertures in a rear wall as well as via the opposite open ends of the hammerbank. The air within the interior of the hammerbank moves upwardly over the magnetic coils and to the outside of the printer through a filtered exit passage.

While the magnetic coil cooling arrangements described in the Kleist et al. and Barrus et al. '668 patents are effective to provide coil cooling in most instances, such schemes are limited in their adaptability to certain hammerbank configurations. This is particularly true in the case of more recent hammerbank designs in which printing speed requirements may necessitate incorporating a considerably greater number of hammer springs into a hammerbank of given size. The magnetic hammer actuators may be redesigned in order to accommodate an increased number of hammer springs which are typically of smaller size as well as more closely spaced. The resulting high performance hammerbank typically does not lend itself to cooling through use of coil-mounted fins or configurations in which air is simply passed through the interior of the hammerbank.

In hammerbanks of the type described in the previously referred to U.S. Pat. No. 3,941,051 of Barrus et al., there is a certain amount of magnetic interaction that occurs between adjacent magnetic hammer actuators due to their close physical proximity and in some cases the use of common components. A certain amount of magnetic interaction is tolerable, particularly where the performance requirements are not especially great. Where printing speeds are increased, however, and particularly where the magnetic hammer actuators must be more closely spaced in order to accommodate increased numbers of hammer springs, the problem posed by magnetic interaction becomes much more serious.

To minimize the effects of magnetic interaction between adjacent magnetic hammer actuators, a number of techniques have been utilized. One technique which is described in U.S. Pat. No. 4,280,404 of Barrus et al., PRINTER HAVING VARIABLE HAMMER RELEASE DRIVE, which patent issued Jul. 28, 1981 and is commonly assigned with the present application, involves varying the current applied to the coils in accordance with the number of hammers being simultaneously fired. In another technique which is described in U.S. Pat. No. 4,386,563 of Farb, PRINTING SYSTEM HAVING STAGGERED HAMMER RELEASE, which patent issued Jun. 7, 1983 and is commonly assigned with the present application, alternate hammer springs are fired at different points in each firing interval so that adjacent hammer springs are not fired simultaneously. While the alternative hammer firing techniques described in these patents are effective in minimizing the effects of magnetic interaction for many applications, it would be advantageous to avoid the need for such techniques and the additional equipment and operational complexities that accompany them. Ideally, hammer firing times should be independent of such considerations so that dot spacing on the paper can be infinitely variable.

Most hammerbanks of the type described in previously referred to U.S. Pat. No. 3,941,051 of Barrus et al. include a pair of elongated, generally cylindrical shafts attached to the opposite ends thereof and slidably mounted within bearings to permit the reciprocating motion of the hammerbank. Typically, such shafts are of said configuration and are secured to the opposite ends of the hammerbank such as by gluing. Despite the considerable care which is taken when gluing the shafts to the opposite ends of the hammerbank, the shafts do not always precisely align along a common axis of elongation of the hammerbank, and the strength of the resulting bond between the shafts and the hammerbank sometimes proves to be inadequate. Accordingly, the mounting shaft arrangement within hammerbanks of this type could be improved upon.

In hammerbanks of the type described in previously referred to U.S. Pat. No. 3,941,951 of Barrus et al., the hammer springs which are disposed in generally parallel, spaced-apart relation along the length of the hammerbank are secured at their lower ends to a hammer mounting surface extending along the length of the hammerbank. Typically, each hammer spring is secured to the hammer mounting surface by a relatively short screw which extends through a mounting plate, through the lower end of the hammer spring and then into a screw hole extending into the hammerbank from the hammer spring mounting surface. Because of hammerbank design considerations, the screw holes are typically of limited length, requiring that relatively short screws be used to mount the hammer springs. Frequently, debris such as dirt and oil from the surrounding parts accumulates between the tip of the screw and the back of the screw hole after the screw has been installed. A more desirable hammerbank configuration would not so limit the hammer spring mounting screw size or trap debris in the screw holes.

In hammerbanks of the type described in previously referred to U.S. Pat. No. 3,941,051 of Barrus et al., a cover assembly is mounted on the hammerbank at the interface between the hammerbank and an adjacent paper-supporting platen. The cover assembly receives a length of ink ribbon therein from the ribbon deck and holds the length of ink ribbon between the dot printing impact tips on the hammer springs and the platen-supported print paper. As the various hammer springs are fired, the dot printing impact tips extend through apertures in the cover assembly so that small portions of the length of ink ribbon may be impacted against the print paper. A lower edge of the cover assembly is typically fastenend by screws or other appropriate fasteners to a lower portion of the length of the hammerbank adjacent the lower mounted ends of the hammer springs. The opposite upper edge of the cover assembly is desirably secured in fixed relation relative to the hammerbank.

In the particular hammerbank described in U.S. Pat. No. 3,941,051 of Barrus et al., substantially the entire hammerbank structure carries magnetic flux from the various permanent magnets of the magnetic hammer actuators. Conveniently, the upper edge of the cover assembly is attached to the fixed reference provided by an upper portion of the hammerbank using the magnetic attraction present throughout substantially the entire hammerbank. However, in hammerbank configurations in which the magnetic paths are confined to much smaller areas and do not extend throughout a substantial portion of the hammerbank, other means for securing the upper edge of the cover assembly to the hammerbank must be utilized.

Accordingly, it would be desirable to provide an improved air cooling system for hammerbanks which eliminates the need for heat radiating fins on the magnetic coils and which optimizes the cooling action of moving, pressurized air within a confined space in the hammerbank. It would furthermore be advantageous to provide a hammerbank in which the magnetic interaction between closely spaced magnetic hammer actuators is minimized so that the firing of each hammer spring can occur independently of other hammer spring firings and without the need for compensatory techniques such as varied coil current or staggered firing times. It would still furthermore be advantageous to eliminate the need for separate shafts attached to the opposite ends of the hammerbank in order to mount the hammerbank for reciprocating motion. It would still furthermore be advantageous to provide a hammerbank in which hammer spring mounting screws of longer configuration can be used and without trapping debris within the backs of the screw holes. It would still furthermore be advantageous to provide alternative arrangements for securing the upper edge of the cover assembly to the hammerbank in instances where less than substantially all of the hammerbank is magnetized by the permanent magnets of the magnetic hammer actuators. It would still furthermore be advantageous to provide a hammerbank in which portions of components within the magnetic hammer actuators are configured to enhance the confinement and flow of cooling air over the magnetic coils.

BRIEF SUMMARY OF THE INVENTION

The foregoing and other objects and features in accordance with the invention are accomplished by providing an improved hammerbank design having features which overcome many of the problems of hammerbanks of the prior art.

Hammerbanks in accordance with the invention utilize an improved air cooling system in which pressurized air is introduced into a common plenum formed at the bottom of an elongated cavity within a shuttle base in which the hammerbank resides. The hammerbank is provided with an arrangement of apertures spaced along the length thereof, which apertures draw air from the common plenum into a first plenum in a region between the hammer springs and the hammerbank below the magnetic coils in a manner which introduces the air into the first plenum in a turbulent, high velocity condition. As a result, cooling is maximized within the confined space of the first plenum and in the presence of a large number of magnetic coils to be cooled.

In a preferred arrangement of a hammerbank according to the invention, the plurality of apertures extending through the hammerbank from the common plenum comprises first and second pluralities of apertures. The apertures of the first plurality extend generally vertically between the bottom of the hammerbank and the first plenum. Each aperture of the second plurality extends generally horizontally between the back of the hammerbank at an upper portion of the common plenum and the first plenum. Each aperture of the second plurality extends through an elongated cavity within the hammerbank that forms a second plenum. Also, the positions of the apertures within the first and second pluralities are staggered along the length of the hammerbank. Such arrangement increases the velocity of the air within the first plenum in addition to creating considerable air turbulence so that cooling of the magnetic coils at the upper end of the first plenum is optimized.

In accordance with one particular feature of the improved air cooling systems of the invention, the magnetic coils are mounted on bobbins having enlarged flanges at the outer ends thereof adjacent the upper movable portions of the hammer springs. The bobbin flanges extend into close juxtaposition with one another to form an air dam. The air dam prevents most of the turbulent, high velocity air in the first plenum from escaping laterally through spaces between the adjacent hammer springs. Instead, the air is essentially confined to the first plenum so as to move upwardly over the magnetic coils and provide the desired cooling action.

In improved hammerbanks according to the invention, magnetic interaction between adjacent magnetic hammer actuators is minimized by the use of essentially independent magnetic circuits which, with one exception, are not intercoupled by common magnetic elements. Each magnetic hammer actuator is comprised of a pair of pole pieces having a permanent magnet disposed therebetween adjacent rear portions of the pole pieces and having magnetic coils mounted on forward portions of the pole pieces. Each pair of pole pieces and the included permanent magnet are mounted within a groove in a common member of aluminum or other non-magnetic material forming part of the hammerbank. The resulting magnetic circuit of each magnetic hammer actuator is confined to the small region encompassed by the permanent magnet, the pair of pole pieces with their included magnetic coils and the small portion of the hammer spring at the upper end thereof extending between the pair of pole pieces.

The hammerbank includes a plurality of the permanent magnets, each of which is common to a different plurality of the magnetic hammer actuators such that a portion of a permanent magnet extends through the space between each adjacent pair of magnetic hammer actuators. The presence of the permanent magnets in the spaces between the magnetic hammer actuators serves to greatly limit the amount of fringing magnetic flux which would otherwise flow between the adjacent rear portions of each pair of pole pieces.

Further in accordance with the invention the hammerbank is comprised of two different elongated members which enclose a single, integrally formed shaft therebetween. The single shaft which extends beyond the opposite ends of the hammerbank to facilitate mounting of the hammerbank for reciprocating motion is of hollow configuration in order to minimize the weight of the hammerbank. At the same time the presence of a single shaft enhances the strength of the overall structure as well as eliminating the need to fasten different shafts to the opposite ends of the hammerbank such as by gluing. Moreover, the single integral configuration of the shaft insures axial alignment of the opposite ends thereof where the hammerbank is mounted within opposite bearings.

In hammerbanks according to the invention the screw holes for mounting the hammer springs extend into the hammerbank from the hammer spring mounting surface and terminate within various ones of the first plurality of apertures forming a part of the improved cooling system. As a result each screw hole is open at both ends with one end being open to the outside of the hammerbank at the hammer spring mounting surface and the other end being open to the interior of one of the first plurality of apertures in the hammerbank. Therefore, longer hammer spring mounting screws can be accommodated, with the tip of the screw extending into the attached cooling aperture if the additional space is needed. In addition, accumulation of oil or other debris within the screw hole is avoided.

In hammerbanks according to the invention, the upper portions of the cover assembly are secured to the hammerbank using separate magnetic clip assemblies attached to the hammerbank. This eliminates the need for all or substantially all of the hammerbank to be magnetized. Each magnetic clip assembly includes a pair of spaced-apart pins mounted on and extending outwardly from an upper portion of the hammerbank. An elongated base clip extends between and has the opposite ends thereof secured to the outer ends of the two pins. A permanent magnet is secured to an intermediate portion of the base clip between the opposite ends thereof. The magnetic attraction of the permanent magnet holds an adjacent portion of the cover assembly in contact therewith. The entire magnetic clip assembly including the base clip, the permanent magnet and the outer ends of the pins may be ground off to provide a common reference surface of desired position relative to the hammerbank against which the cover assembly is held.

BRIEF DESCRIPTION OF THE DRAWINGS

A better understanding of the invention may be had by reference to the following description, taken in conjunction with the accompanying drawings, in which:

FIG. 1 is an exploded perspective view of the major components of a printer including a shuttle assembly which has an improved hammerbank in accordance with the invention;

FIG. 2 is a perspective view of the components of FIG. 1 shown in conjunction with a ribbon deck and a tractor drive arrangment within a printer;

FIG. 6 is a sectional view of the shuttle base of FIG. 5 mounted on a base support member shown in FIG. 1 in conjunction with an air chamber and duct for supplying pressurized air;

FIG. 14 is a perspective view of a small portion of the hammerbank of FIG. 1 illustrating the manner in which air flows into a first plenum in accordance with an improved air cooling system;

FIG. 15 is a sectional view of the shuttle assembly of FIG. 1 taken along the lines 15—15 of FIG. 7 and illustrating the manner in which the opposite ends of the hammerbank of FIG. 1 are sealed in accordance with the improved air cooling system;

FIG. 16 is a perspective view of four different pairs of pole pieces and a common permanent magnet forming major portions of four different magnetic hammer actuators on the hammerbank of FIG. 1;

FIG. 17 is a front view of the four pairs of pole pieces and the common permanent magnet of the arrangment of FIG. 16 illustrating the manner in which fringing magnetic flux is limited by the presence of the permanent magnet;

DETAILED DESCRIPTION

Figure 3:
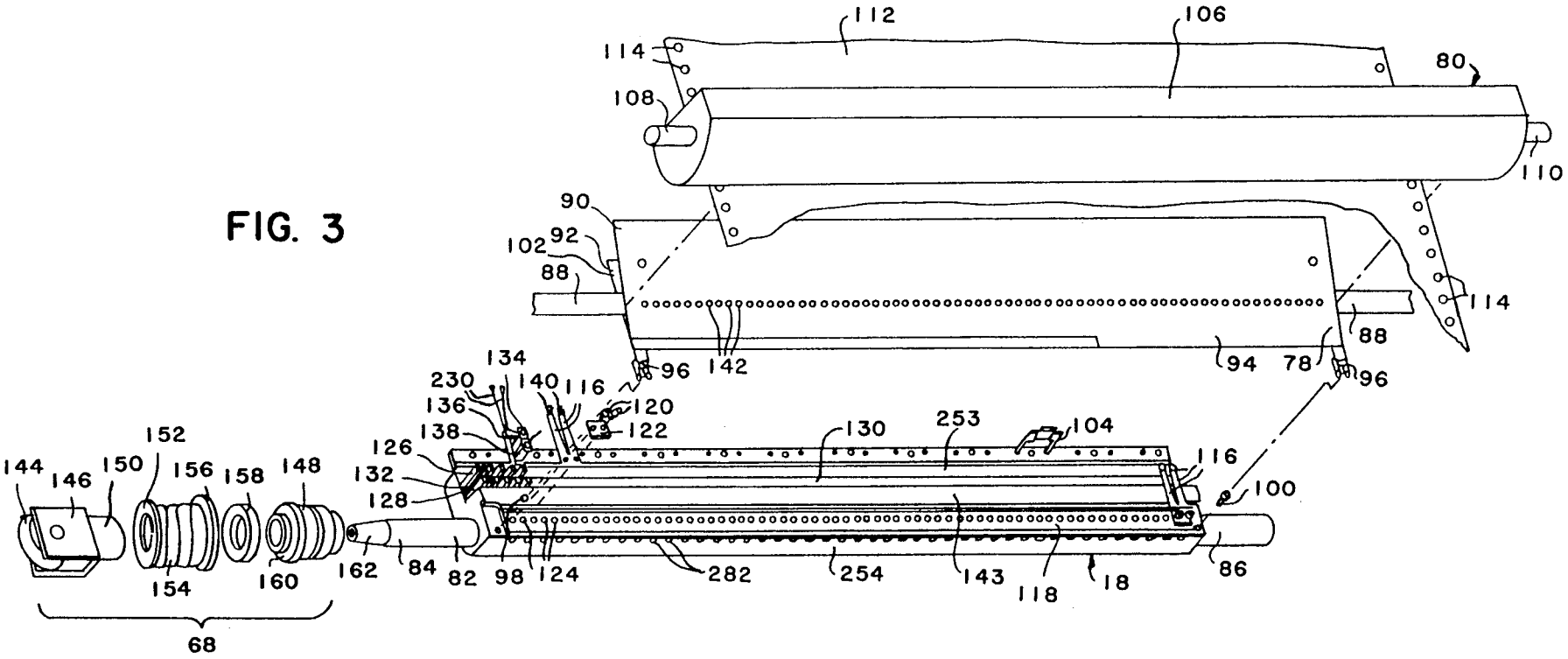
FIG. 3 is an exploded perspective view of the improved hammerbank of FIG. 1 together with a cover assembly and an elongated platen contained within the shuttle assembly of FIG. 1.

FIG. 1 depicts a shuttle assembly 10 in conjunction with other components of a printer 12 including a base support member 14 having a cam drive assembly 16 mounted thereon. The shuttle assembly 10 includes an improved hammerbank 18 in accordance with the invention which is described in detail hereafter. The base support member 14 forms a part of a frame structure for the printer 12 and has the shuttle assembly 10 removably mounted thereon. An elongated, hollow air chamber 20 which is mounted on the bottom of the base support member 14 opposite the shuttle assembly 10 is coupled by a duct 22 to a blower 24 or other source of pressurized air.

As described in greater detail in a copending application of Farb et al., Ser. No. 069,486, filed Jul. 1, 1987, and entitled "PRINTER HAVING INTERCHANGEABLE SHUTTLE ASSEMBLY", now abandoned which application is commonly assigned with the present application, the shuttle assembly 10 comprises an integral, modular unit which is interchangeable within the printer 12. In this manner, difficult and critical adjustments can be made to the shuttle assembly 10 and to the hammerbank 18 therein during manufacture of the shuttle assembly 10 at the factory. Thereafter, if it becomes necessary to install or replace the hammerbank 18 while the printer 12 is in the field or other remote location, the interchangeable shuttle assembly 10 which already has the critical adjustments made thereto is easily installed in or removed from the printer 12.

As shown in FIG. 1 the shuttle assembly 10 includes an elongated shuttle base 26 having the hammerbank 18 mounted therein. The shuttle base 26 includes a lug 28 at a lefthand end 30 thereof, which lug 28 has an aperture 32 therethrough. An opposite righthand end 34 of the shuttle base 26 includes a pair of lugs (not shown in FIG. 1), each of which has an aperture therethrough.

The shuttle assembly 10 is removably mounted on the base support member 14 using three bolts 36, 38 and 40. The bolt 36 extends through the aperture 32 in the lug 28 and into the base support member 14 to secure the lefthand end 30 of the shuttle base 36 to the base support member 14. In similar fashion the bolts 38 and 40 extend through the apertures in the lugs at the righthand end 34 of the shuttle base 26 and into the base support member 14 to secure the righthand end 34 of the shuttle base 26 to the base support member 14. A pin 42 which extends upwardly from a generally horizontal top surface 44 of the base support member 14 adjacent the righthand end 34 of the shuttle base 26 is received within a mating aperture in the bottom of the shuttle base 26 to properly position the righthand end 34 of the shuttle base 26 on the base support member 14. The pin receiving aperture is shown and described hereafter in connection with FIG. 12.

As described in the previously referred to copending application Ser. No. 069,486 of Farb et al., the shuttle assembly 10 is easily and yet accurately installed on the base support member 14 within the printer 12 by lowering the shuttle assembly 10 onto the base support member 14 within the printer 12 so that the pin 42 is inserted into the mating aperture in the bottom of the righthand end 34 of the shuttle base 26. The shuttle assembly 10 is then rotated about the pin 42 to move the lefthand end 30 of the shuttle base 26 forward until a platen retaining plate 46 at the lefthand end 30 is received within a mating opening 48 in a tractor drive 50 which is shown in FIG. 2. The tractor drive 50 comprises the lefthand one of a pair of tractor drives 50 and 52 which together comprise a tractor drive arrangement 54 for the printer 12. When the platen retaining plate 46 is seated within the mating opening 48, the bolts 36, 38 and 40 are inserted through the lugs and into the base support member 14 and are loosely tightened. Following minor adjustment to properly orient the shuttle assembly 10 relative to the cam drive assembly 16 and the tractor drive arrangement 54, the bolts 36, 38 and 40 are tightened. Following that, a ribbon deck 56 is mounted on the front of the shuttle assembly 10 by a pair of bolts 58 and 60 as shown in FIG. 2.

Removal of the interchangeable shuttle assembly 10 from the printer 12 involves a reversal of the procedure just described. The ribbon deck 56 is removed from the shuttle assembly 10, following which the bolts 36, 38 and 40 are removed. This enables the shuttle assembly 10 to be pivoted about the pin 42 to withdraw the platen retaining plate 46 from the mating opening 48 in the tractor drive 50. The shuttle assembly 10 may then be lifted off of the base support member 14 and removed from the printer 12.

The shuttle assembly 10 has a print station therein defined by a small gap of uniform size between the hammerbank 18 and an adjacent platen 106. With a length of print paper disposed within the print station together with a length of ink ribbon from the ribbon deck 56, the hammerbank 18 prints on the print paper in dot matrix fashion as described hereafter. The print paper is incremented through the print station in the shuttle assembly 10, dot line by dot line, in conventional fashion using the tractor drive arrangement 54. The tractor drive arrangement 54 incrementally advances the print paper upwardly using the opposite tractor drives 50 and 52 which engage perforations in the opposite edges of the print paper.

The cam drive assembly 16 is of appropriate conventional design such as the type described in previously referred to U.S. Pat. No. 3,941,051 of Barrus et al. The cam drive assembly 16 includes a driven flywheel 64 which is coupled to a cam 66. The cam 66 is engaged at one side thereof by a cam follower assembly 68 which is coupled to one end of the hammerbank 18. A counterbalancing assembly 70 engages a side of the cam 66 opposite the cam follower assembly 68 and is driven in opposite, out-of-phase fashion from the hammerbank 18 in response to rotation of the cam 66. The counterbalancing assembly 70 compensates for the reciprocating motion of the hammerbank 18 to eliminate the shaking or other vibratory motion which would otherwise result.

The hammerbank 18 and particularly the magnetic coils of magnetic hammer actuators included therein are cooled by a system which utilizes pressurized air. The pressurized air is provided by the blower 24 which is shown in FIG. 1. The blower 24 forces air under pressure through the duct 22 and into the elongated air chamber 20 which is coupled to the bottom of the base support member 14 and which is sealed relative thereto by a foam seal 72 mounted on the top of the air chamber 20. The top of the air chamber 20 is provided with an elongated slot 74 through which the pressurized air in the air chamber 20 passes. The pressurized air passing upwardly through the slot 74 enters and passes through a series of four apertures 76 in the base support member 14. The apertures 76 are arranged in an elongated configuration so as to be disposed above and generally coextensive with the slot 74 in the air chamber 20.

As described hereafter, the bottom of the shuttle base of the shuttle assembly 10 includes four apertures which are disposed over the apertures 76 in the base support member 14 in mating fashion when the shuttle assembly 10 is mounted on the base support member 14. Pressurized air passing upwardly through the apertures 76 in the base support member 14 from the air chamber 20 enters the shuttle assembly 10 through the apertures in the bottom of the shuttle base 26.

Figure 4:
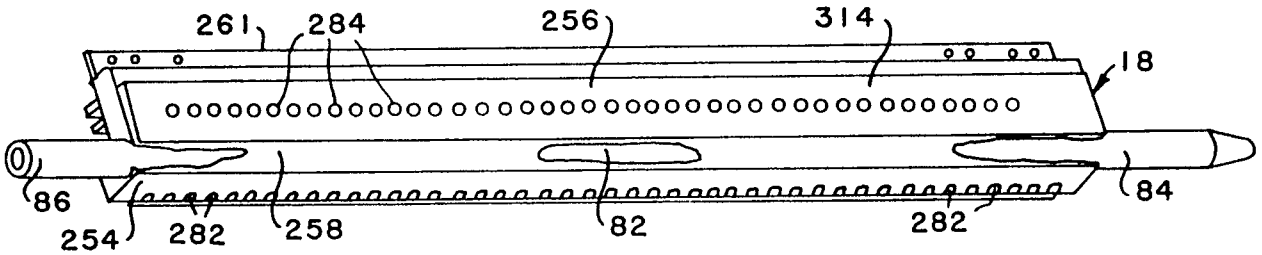
FIG. 4 is a perspective, partly broken-away view of the hammerbank of FIG. 1.

FIG. 3 is an exploded perspective view showing the hammerbank 18, a cover assembly 78, an elongated platen assembly 80 and the cam follower assembly 68 contained within and forming a part of the shuttle assembly 10. The hammerbank 18 includes a single, integrally formed, hollow shaft 82 mounted therein and extending along the length thereof. The opposite ends of the shaft 82, which is of hollow, cylindrical configuration, extend outwardly from the opposite ends of the hammerbank 18 to provide a pair of opposite shafts lengths 84 and 86 external to the hammerbank 18. As described hereafter, the shafts lengths 84 and 86 are received within linear sleeve bearings mounted in the shuttle base 26 to permit reciprocating motion of the hammerbank 18 along the axis of elongation of the shaft 82. The cam follower assembly 68 is mounted on the end of the shaft length 84 and engages the cam 66 of the cam drive assembly 16 to drive the hammerbank 18 in reciprocating fashion. FIG. 4 which is partly broken away shows the manner in which the single shaft 82 extends along the entire length of the hammerbank 18 on the inside of the hammerbank 18.

The cover assembly 78 which is mounted on the hammerbank 18 receives a length of ink ribbon 88 therein from the ribbon deck 56. The cover assembly 78, which is of folded configuration so as to have front and rear portions 90 and 92 thereof with the length of ink ribbon 88 disposed therebetween, has a lower edge 94 thereof secured to the hammerbank 18 along the length of the hammerbank 18. The cover assembly 78 is secured to the hammerbank 18 along the lower edge 94 thereof such as by fasteners 96 coupled to opposite ends of the lower edge 94 and secured to the opposite ends of the hammerbank 18 by bolts 98 and 100.

Figure 19:
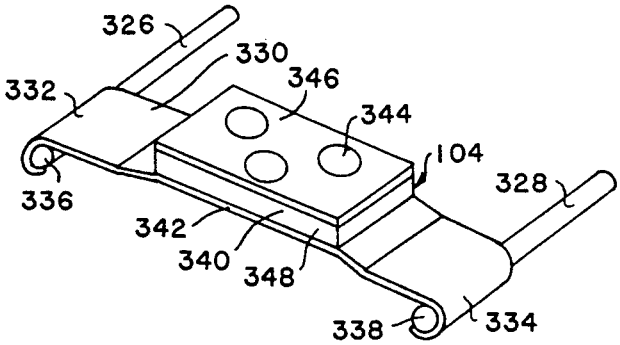
FIG. 19 is a perspective view of a magnetic clip assembly in accordance with the invention for securing an upper portion of a cover assembly in fixed relation to an upper portion of the hammerbank of FIG. 1.

An upper edge 102 of the cover assembly 78 opposite the lower edge 94 is secured in a fixed position relative to an upper portion of the hammerbank 18 by a plurality of magnetic clip assemblies 104 mounted in spaced-apart relation along an upper portion of the hammerbank 18. The magnetic clip assemblies 104 which are described in greater detail hereafter in connection with FIG. 19 can be precision ground following installation on the hammerbank 18 to define reference surfaces that are precisely located relative to the upper portion of the hammerbank 18. The upper edge 102 of the cover assembly 78 is held against the reference surfaces of the magnetic clip assemblies 104 by magnetic attraction.

As previously noted, the cover assembly 78 which is mounted on the hammerbank 18 forms a small gap of uniform size to define a print station in which the print paper resides. The print station is formed by the cover assembly 78 in conjunction with an elongated platen 106 which together with a pair of shafts 108 and 110 at the opposite ends thereof forms the platen assembly 80. The platen assembly 80 is mounted in generally parallel, spaced-apart relation relative to the hammerbank 18 such that the shafts 108 and 110 lie along a common axis which is parallel to the axis of elongation of the shaft 82 of the hammerbank 18. The platen 106 supports a length of print paper 112 having perforations 114 along opposite edges thereof. The perforations 114 at the opposite edges of the print paper 112 are engaged by the opposite tractor drives 50 and 52 shown in FIG. 2 to provide incremental upward movement of the print paper 112 through the print station.

In the present example, the hammerbank 18 has a total of sixty six hammer springs 116 mounted along the length thereof in spaced-apart, parallel fashion. Only four of the hammer springs 116 are shown in FIG. 3 for ease of illustration. The hammer springs 116 are mounted along a hammer spring mounting surface 118 extending along the length of the hammerbank 18. Each hammer spring 116 has a lower end thereof secured to the mounting surface 118 by a screw 120 which extends through a mounting plate 122, through a lower end of the hammer spring 116, and into a screw hole 124 which extends into the hammerbank 18 from the mounting surface 118.

Associated with each hammer spring 116 is a different pair of pole pieces 126 and 128 mounted within a groove 130 extending along an upper portion of the hammerbank 18 spaced-apart from and generally parallel to the hammer spring mounting surface 118. The pole pieces 126 and 128 form part of a magnetic hammer actuator for the hammer spring 116. Pole pieces 126 and 128 have a permanent magnet 132 disposed therebetween within the groove 130. A coil assembly 134 forming a part of the magnetic hammer actuator includes a first magnetic coil 136 mounted on the first pole piece 126 and a second magnetic coil 138 mounted on the second pole piece 128. The first and second magnetic coils 136 and 138 are disposed on the pole pieces 126 and 128 outside of the groove 130 and adjacent an upper free end of the hammer spring 116.

The hammer springs 116 are made of resilient magnetic material such as spring steel. Each hammer spring 116 is normally held in a slightly flexed, spring-loaded retracted position against the tips of the pole pieces 126 and 128 by action of the permanent magnet 132 which completes a magnetic path through the pole pieces 126 and 128 and an adjacent upper portion of the hammer spring 116. Each of the hammer springs 116 has a dot printing impact tip 140 mounted thereon at the upper free end of the hammer spring 116. Each of the impact tips 140 is disposed adjacent a different pair of apertures 142 in the front and rear portions 90 and 92 of the cover assembly 78.

During printing and as the hammerbank 18 is reciprocated relative to the platen 106, the various hammer springs 116 are selectively released or "fired" to print dots on the length of print paper 112 supported by the platen 106. Release of each hammer spring 116 is accomplished by energizing the first and second coils 136 and 138 of the coil assembly 134 associated therewith long enough to overcome the magnetic holding force of the permanent magnet 132 and send the upper free end of the hammer spring 116 flying away from the pole pieces 126 and 128. As the hammer spring 116 moves away from the pole pieces 126 and 128, the impact tip 140 extends through the associated pair of apertures 142 in the cover assembly 78 to impact the length of ink ribbon 88 disposed between the front and rear portions 90 and 92 of the cover assembly 78 against the length of print paper 112 which is supported by the platen 106. Following impact, the hammer spring 116 rebounds back into the retracted position against the pole pieces 126 and 128 where it remains in the retracted position in preparation for the next release of the hammer spring 116. Movement of the hammer spring 116 into the retracted position is damped by a Kapton strip 143 extending along the length of the hammerbank 18 between the hammer spring mounting surface 118 and the groove 130 containing the pole pieces 126 and 128. The Kapton strip 143 which is disposed adjacent intermediate portions of the hammer springs 116 is comprised of several layers of Kapton sandwiched together to form the strip 143.

As noted above, the cam follower assembly 68 is mounted on the shaft length 84 so as to drive the hammerbank 18 in reciprocating fashion in response to the cam drive assembly 16. The cam follower assembly 68 includes a roller bearing 144 rotatably mounted within a yoke 146 so as to extend outwardly from the yoke 146 and into engagement with the cam 66 of the cam drive assembly 16. The yoke 146 is coupled to a bearing assembly 148 by a collar 150 in the back of the yoke 146. The collar 150 extends through a washer 152, a coiled shuttle spring 154 and washers 156 to an end of the bearing assembly 148 surrounded by a reservoir 158 which engages a felt oil wick 160 at the end of the bearing assembly 148.

The bearing assembly 148 is mounted on a tapered end 162 of the shaft length 84. A set screw which is not shown and which is loosely confined within the collar 150 of the yoke 146 is mounted within the tapered end 162 of the shaft length 84. The set screw defines the extent to which the yoke 146 can move away from the tapered end 162 while at the same time permitting limited movement of the yoke 146 toward the tapered end 162 against the resistance of the spring 154 to absorb shocks as the roller bearing 144 follows the cam 66.

Figure 5:
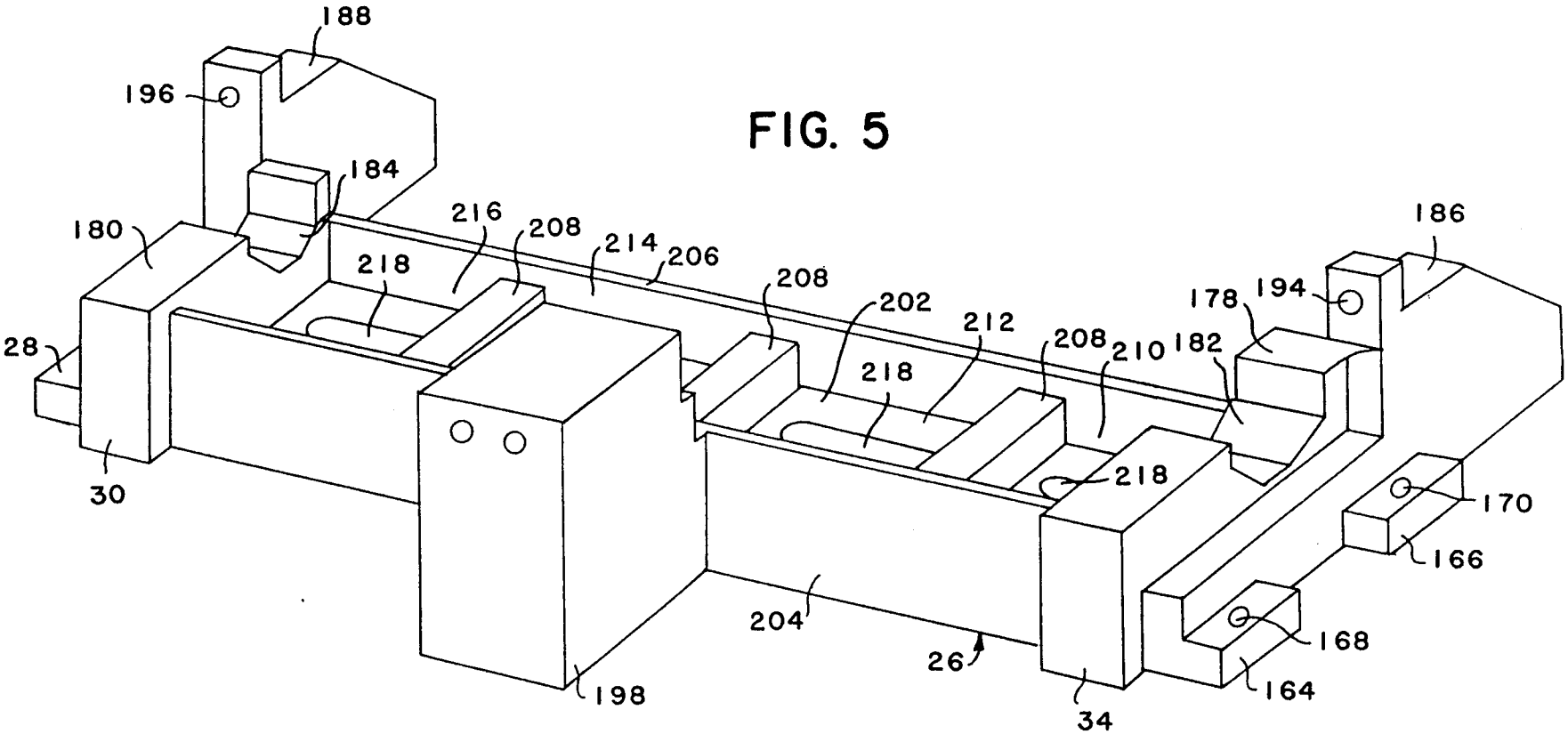
FIG. 5 is a perspective view of the elongated shuttle base of the shuttle assembly of FIG. 1.

The hammerbank 18 with the cover assembly 78 and the cam follower assembly 68 mounted thereon, and the platen assembly 80, are mounted on the shuttle base 26 which is shown in detail in FIG. 5. The shuttle base 26 is of elongated, generally rectangular configuration between the lefthand and righthand ends 30 and 34 thereof. As previously noted in connection with FIGS. 1 and 2, the lefthand end 30 includes the lug 28 with the aperture 32 therethrough for receiving the bolt 36. The righthand end 34 of the shuttle base 36 includes a spaced-apart pair of lugs 164 and 166 having apertures 168 and 170 therethrough for receiving the bolts 40 and 42 shown in FIG. 1.

The shuttle base 26 is configured to define bearing blocks 178 and 180 at the righthand and lefthand ends 34 and 30 thereof respectively. The bearing block 178 has a recess 182 therein, while the bearing block 180 has a recess 184 therein. The recesses 182 and 184 are adapted to handle linear sleeve bearings mounted therein which receive the shaft lengths 84 and 86 of the hammerbank 18. This enables the hammerbank 18 to reciprocate along the axis of elongation of the shaft 82, which axis of elongation extends in the direction of elongation of the shuttle base 26.

The shuttle base 26 is also configured to define a bearing surface 186 adjacent and behind the recess 182 and a bearing surface 188 behind and adjacent the recess 184. The bearing surfaces 186 and 188 are designed to receive the shafts 108 and 110 respectively at the opposite ends of the platen 106. As described in greater detail in the previously referred to copending application Ser. No. 69,486 of Farb et al., the shafts 108 and 110 are held in place on the bearing surfaces 186 and 188 by clamping assemblies 190 and 192 which are shown in FIGS. 8–11. The clamping assemblies 190 and 192 permit rotation of the shafts 108 and 110 thereon in order to vary the angular orientation of the platen 106. Apertures 194 and 196 within the shuttle base 26 adjacent the bearing surfaces 186 and 188 receive mechanisms for adjusting the lateral positions of the shafts 108 and 110.

The shuttle base 26 further includes an anti-rotation block 198 which forms part of an anti-rotation assembly 200 described in greater detail in the previously referred to co-pending application Ser. No. 69,486 of Farb et al. The anti-rotation assembly 200, which is shown in some detail in the sectional view of FIG. 13, prevents rotation of the hammerbank 18 while at the same time permitting reciprocating movement of the hammerbank 18.

As shown in FIG. 5, the shuttle base 26 has a bottom 202 thereof which extends along the length thereof between opposite front and rear walls 204 and 206. The bottom 202 and the front and rear walls 204 and 206 extend along the length of the shuttle base 26 between the opposite bearing blocks 178 and 180. The anti-rotation block 198 extends outwardly from the front wall 204 at an intermediate portion along the length of the front wall 204. The bottom 202 is configured to define three different cross members 208 extending between the front and rear walls 204 and 206. The cross members 208 together with the transversely disposed bearing blocks 178 and 180 divide the length of the bottom 202 into four different compartments 210, 212, 214 and 216.

Figure 12:
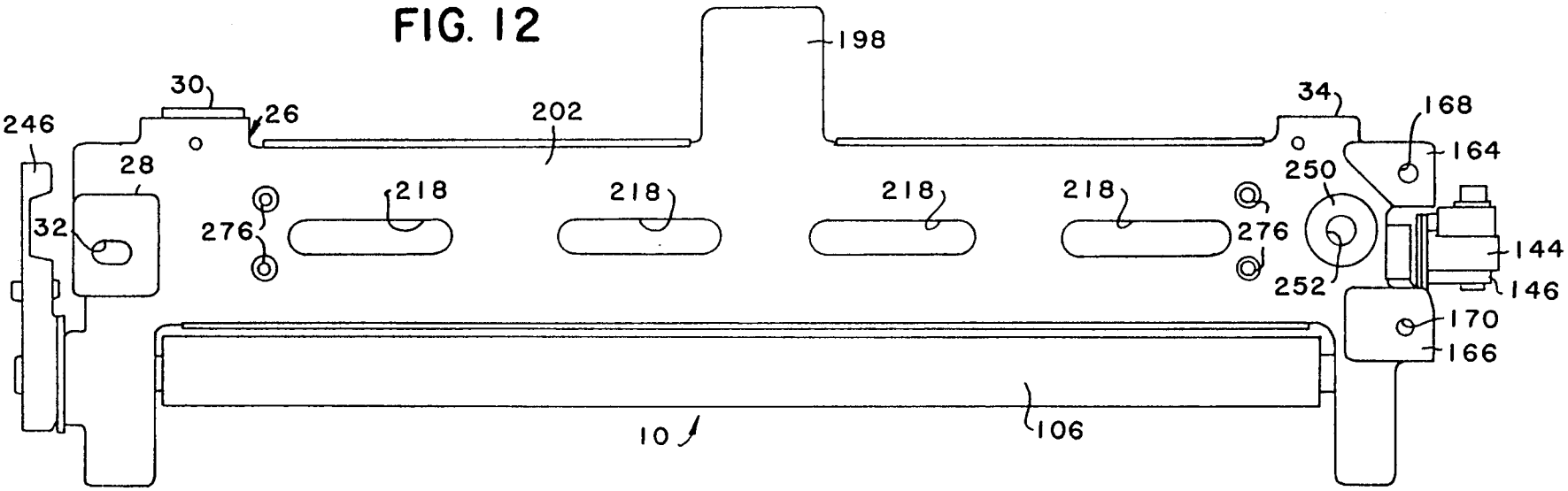
FIG. 12 is a bottom view of the shuttle assembly of FIG. 1.

Each of the four compartments 210, 212, 214 and 216 within the shuttle base 26 has an aperture 218 extending therethrough. This is also shown in FIG. 12 which is a bottom view of the completed shuttle assembly 10. The four different apertures 218 which are spaced-apart from each other and which form an elongated aperture configuration align with the apertures 76 in the base support member 14 to receive pressurized air introduced into the apertures 76. The pressurized air admitted by the apertures 218 in the bottom 202 of the shuttle base 26 flows into an elongated cavity extending along the length of the shuttle base 26 above the compartments 210, 212, 214 and 216. As described hereafter, such elongated cavity forms a common plenum at the bottom and back of the hammerbank 18 when the hammerbank 18 is mounted in the shuttle base 26.

FIG. 6 is a side view, mostly in section, of the shuttle base 26 together with the base support member 14, the air chamber 20 and the duct 22. As previously described in connection with FIG. 1, the blower 24 forces air under pressure through the duct 22 and into the hollow interior of the air chamber 20. The pressurized air within the air chamber 20 rises through the slot 74 at the top thereof and into the four different apertures 76 in the base support member 14. As shown in FIG. 6, the pressurized air introduced into the apertures 76 passes therethrough and into the apertures 218 in the bottom surface 202 of the shuttle base 26. From the apertures 218 the pressurized air enters the compartments 210, 212, 214 and 216 in the shuttle base 26 from which it enters the common plenum at the bottom of the hammerbank 18 as described hereafter. The interface between the horizontal top surface 44 of the base support member 14 and the bottom 202 of the shuttle base 26 is sealed by a piece of sealing tape 220 shown in FIG. 1 as well as in FIG. 6.

FIGS. 7–13 comprise various different views of the completed shuttle assembly 10. The shaft length 84 at one end of the hammerbank 18 is slidably journaled within a linear sleeve bearing 222 mounted within the recess 182 in the bearing block 178. A bearing cap 224 is disposed over the linear sleeve bearing 222 to secure the linear sleeve bearing 222 within the recess 182. In like fashion, the shaft length 86 at the other end of the hammerbank 18 is slidably journaled within a linear sleeve bearing 226 mounted within the recess 184 in the bearing block 180. A bearing cap 228 secured to the bearing block 180 holds the linear sleeve bearing 226 within the recess 184. The details of the linear sleeve bearings 222 and 226 and the manner in which they are adjusted are described in the previously referred to copending application Ser. No. 69,486 of Farb et al.

Figure 8:
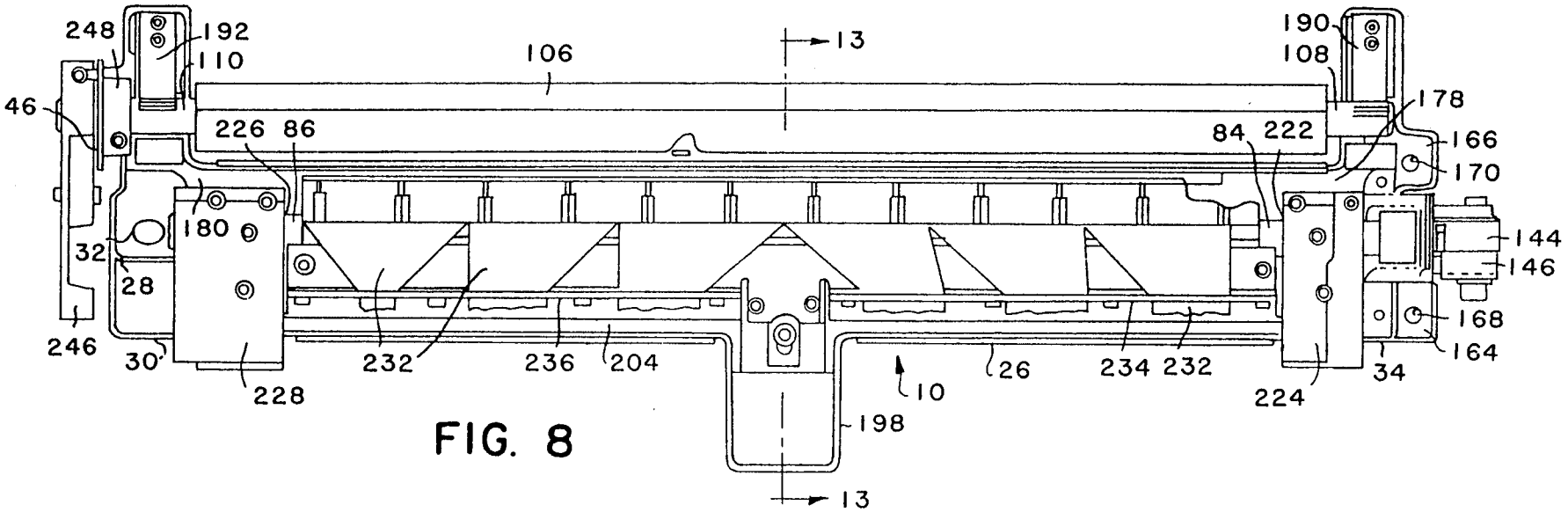
FIG. 8 is a top view of the shuttle assembly of FIG. 1.
Figure 7:
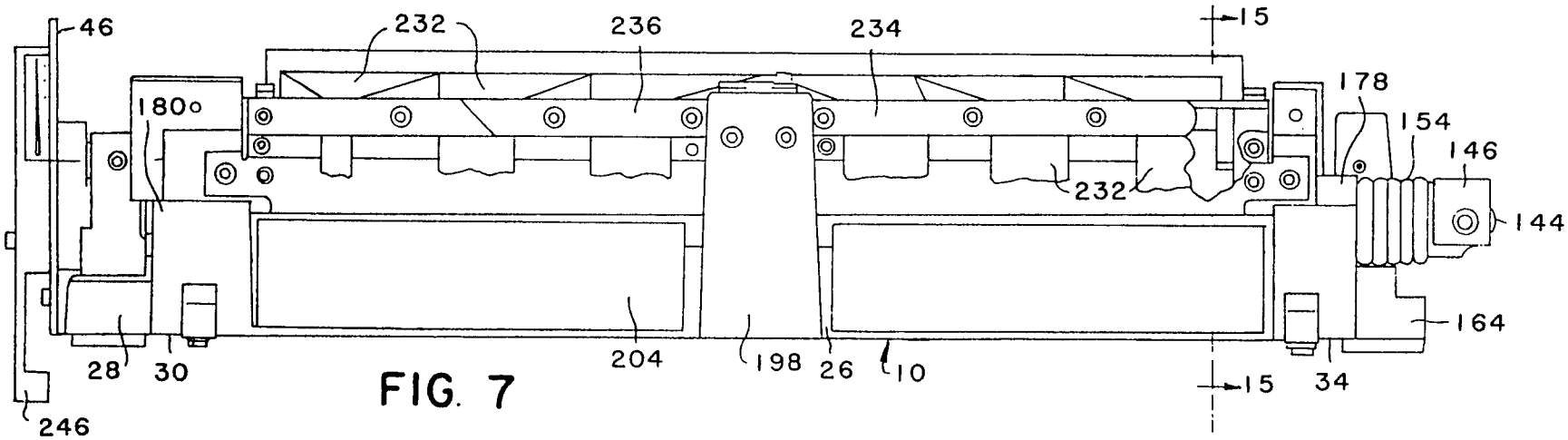
FIG. 7 is a front view of the shuttle assembly of FIG. 1.
Figure 9:
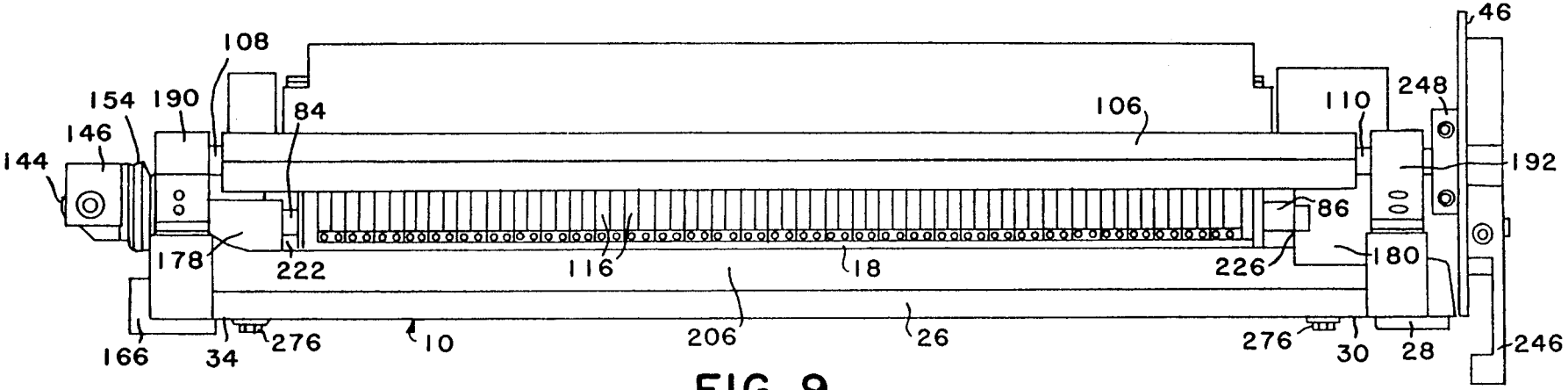
FIG. 9 is a rear view of the shuttle assembly of FIG. 1.
Figure 11:
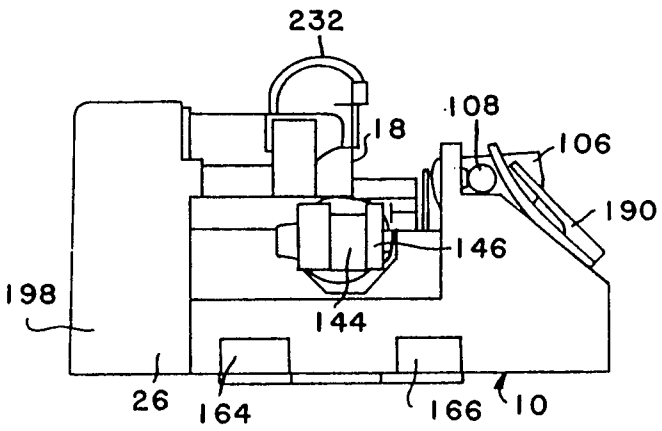
FIG. 11 is a right end view of the shuttle assembly of FIG. 1.
Figure 10:
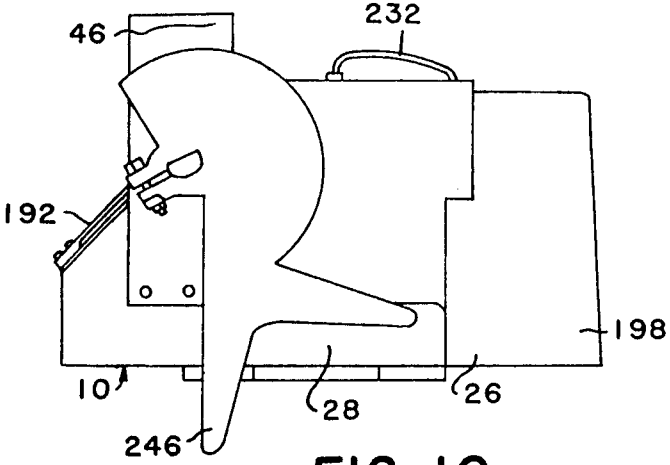
FIG. 10 is a left end view of the shuttle assembly of FIG. 1.

As previously described in connection with FIG. 3, various hammer springs 116 are selectively released by energizing the associated coil assemblies 134. Wire leads 230 for one of the coil assemblies 134 are shown in FIG. 3. The various coil assemblies 134 for the sixty six different hammer springs 116 are coupled to control circuitry external to the shuttle assembly 10. Such coupling is provided by many wire leads such as the leads 230 which are organized into six different wire busses 232 along the length of the hammerbank 118. The wire busses 232 which are best seen in FIGS. 7 and 8 and which extend upwardly from the coil assemblies 134 are clamped in place along the opposite side of the hammerbank 18 by clamping bars 234 and 236. The wire busses 232 which are shown broken off just below the clamping bars 234 and 236 in FIGS. 7 and 8 eventually terminate in connectors which are secured to mating connectors within the printer 12 to complete coupling of the coil assemblies 134 to the control circuitry following installation of the shuttle assembly 10 within the printer 12.

Figure 13:
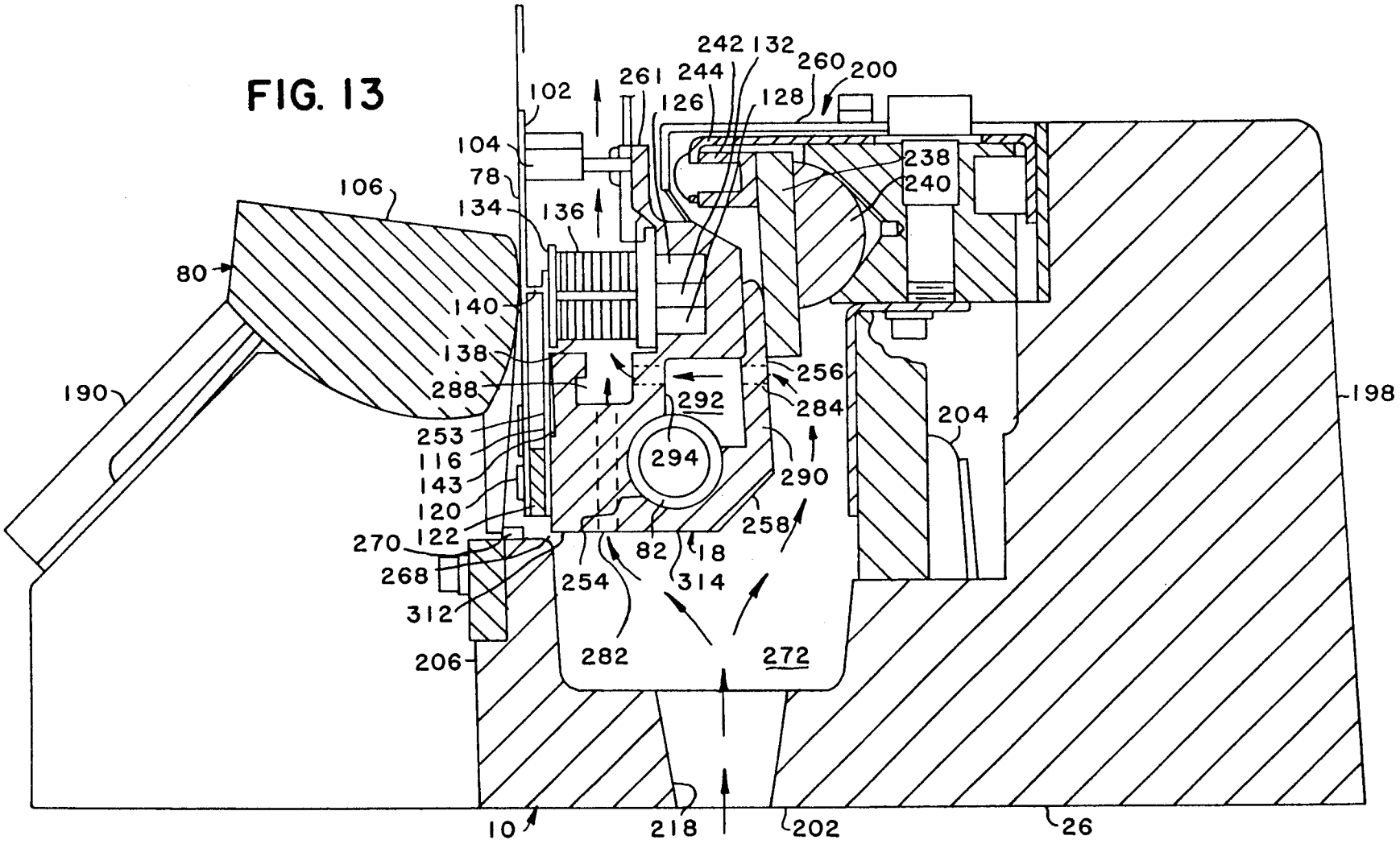
FIG. 13 is a sectional view of the shuttle assembly of FIG. 1 taken along the lines 13—13 of FIG. 8.

FIG. 13 shows the details of the anti-rotation assembly 200 which is described in greater detail in the previously referred to copending application Ser. No. 69,486 of Farb et al. The anti-rotation assembly 200 prevents rotation of the hammerbank 18 by slidably grasping the opposite sides of a metal plate 238 mounted on the back of the hammerbank 18 at a central portion of the hammerbank 18 in a manner which prevents rotation of the hammerbank 18 about the axis of elongation of the shaft 82 while at the same time permitting sliding movement of the metal plate 238 relative thereto so that the hammerbank 18 may undergo reciprocating motion. A generally hemispherically shaped pad 240 slidably engages one side of the metal plate 238, while an anti-recoil pad 242 secured to one end of a slidable, spring-loaded anti-recoil slide 244 slidably engages the opposite side of the metal plate 238.

The platen assembly 80 is provided with a platen handle 246. The platen handle 246 is coupled to the shaft 108 at one end of the platen 106 by an arrangement which includes an adjustable shaft collar 248. As described in detail in the previously referred to copending application Ser. No. 69,486 of Farb et al., the shaft collar 248 is used to adjust the angular orientation of the platen handle 246 relative to the platen 106.

FIG. 12 is a bottom view of the shuttle assembly showing the bottom 202 of the shuttle base 26. As seen in FIG. 12 the bottom 202 has the four apertures 218 therein for admitting pressurized air into the shuttle assembly 10 from the air chamber 20 via the base support member 14. The bottom 202 of the shuttle base 26 also has a bushing 250 disposed therein at the righthand end 34 thereof located between and adjacent the lugs 164 and 166. The bushing 250 has an aperture 252 therein dimensioned to snugly receive the pin 42 therein which is mounted on the horizontal top surface 44 of the base support member 14.

As previously described in connection with FIG. 3 which depicts a front portion 253 of the hammerbank 18, the front portion 253 includes the hammer spring mounting surface 118 for mounting the hammer springs 116 thereon and the groove 130 for mounting the various pole pieces 126 and 128 and the permanent magnets 132 therein. FIG. 3 also illustrates a bottom surface 254 of the hammerbank 18.

FIG. 4 depicts the bottom surface 254 of the hammerbank 18 together with the portion thereof opposite the front portion 253 of the hammerbank 18 shown in FIG. 3. As shown in FIG. 4 the hammerbank 18 has a back surface 256 which joins the bottom surface 254 via an angled lowered surface 258. The integral shaft 82 extends through the interior of the hammerbank 18 along a lower portion of the hammerbank 18 at a location just above the bottom surface 254 and midway between the back surface 256 and the opposite front portion 253 of the hammerbank 18. The hammerbank 18 is mounted within the shuttle base 26 by placing the shaft lengths 84 and 86 at the opposite ends of the hammerbank 18 in the linear sleeve bearings 222 and 226 which are mounted within the recesses 182 and 184 in the bearing blocks 178 and 180 of the shuttle base 26 as previously described. FIG. 13 shows the hammerbank 18 so mounted within the shuttle base 26.

As previously noted in connection with FIG. 5, the shuttle base 26 includes the bottom 202 thereof which extends along the length thereof between the front and rear walls 204 and 206. The bottom 202, front wall 204 and rear wall 206 of the shuttle base 26 are shown in FIG. 13 as well as in FIG. 15 which is a sectional view of the shuttle assembly 10 without the hammerbank 18. FIG. 15 illustrates a shuttle shroud 260 which is coupled to the front wall 204 so as to extend along the length of the shuttle base 26 between the opposite bearing blocks 178 and 180. The shuttle shroud 260 is also shown in FIG. 13 but is partly obscured by the anti-rotation assembly 200 which resides at the very center of the shuttle base 26.

The shuttle shroud 260 together with the front wall 204 and the bottom 202 of the shuttle base 26 form a continuous, sealed, air-tight enclosure along the length of the hammerbank 18 extending from a region below the bottom surface 254 of the hammerbank 18 along the back surface 256 to a top portion 261 of the hammerbank 18. An airtight seal between the top portion 261 of the hammerbank 18 and the shuttle shroud 260 is provided by a strip of polyester film 262 sealed to the inside of a lip 264 at the top extremity of the shuttle shroud 260 by a strip of double-coated tape 266. The film strip 262 and the double-coated tape 266 which are best seen in FIG. 15 extend along the entire length of the shuttle shroud 260 between the opposite bearing blocks 178 and 180 of the shuttle base 26. As the hammerbank 18 reciprocates within the shuttle base 26, the filmstrip 262 which is flexible and resilient bears against the top portion 261 of the hammerbank 18 to maintain a generally air-tight seal therewith.

As shown in FIG. 13 a small opening 268 exists between the rear wall 206 of the shuttle base 26 and the hammerbank 18 along the length of the hammerbank 18. The opening 268 is provided with a seal by a strip of foam tape 270. The foam tape 270 which is mounted on the top of the rear wall 206 along the length thereof extends to a location adjacent the bottom surface 254 of the hammerbank 18 adjacent the front portion 253 of the hammerbank 18. As the hammerbank 18 undergoes reciprocating motion within the shuttle base 26, the foam tape 270 which is flexible and resilient effects a seal between the rear wall 206 of the shuttle base 26 and the hammerbank 18.

It will therefore be seen that the hammerbank 18 resides within an elongated cavity 272 in the shuttle base 26 of the shuttle assembly 10. The elongated cavity 272 has the upper portion thereof enclosed by the shuttle shroud 260 and sealed by the filmstrip 262. The opposite lower portion of the elongated cavity 272 is sealed by the foam tape 270. The opposite ends of the elongated cavity 272 inside of and adjacent the opposite bearing blocks 178 and 180 of the shuttle base 26 are sealed by an opposite pair of sealing arrangements, one of which is shown in FIG. 15. As shown in FIG. 15, a lower end seal 274 is mounted within the shuttle base 26 by a pair of screws 276 and washers 278. The screws 276 extend through the bottom 202 of the shuttle base 26 and into the lower end seal 274 to secure the lower end seal 274 in place. The lower end seal 274 extends across the bottom 202 and between the front and rear walls 204 and 206 and has an upper surface 280 configured to mate with the lower portion of the hammerbank 18 at one end of the hammerbank 18. The lower end seal 274 forms a generally airtight seal with one end of the hammerbank 18 at one end of the elongated cavity 272. A second lower end seal of like configuration to that of the lower end seal 274 is mounted within the shuttle base 26 at the opposite end thereof to mate with the other end of the hammerbank 18 and seal that end of the elongated cavity 272.

It was previously noted that the blower 24 forces air under pressure through the duct 22 and into the air chamber 20 from which the pressurized air passes through the apertures 76 in the base support member 14 and through the apertures 218 in the bottom 202 of the shuttle base 26. As the pressurized air passes through the apertures 218 in the bottom 202 of the shuttle base 26, it enters the elongated cavity 272. The hammerbank 18 is provided with a plurality of apertures therein which draw the pressurized air from the elongated cavity 272 through the interior of the hammerbank 18 to a region which is on the outside of the hammerbank 18 below the coil assemblies 134. The air enters the region below the coil assemblies 134 with increased velocity and substantial turbulence. This enhances the cooling action as the turbulent, high velocity air flows over the coil assemblies 134, enabling a substantial amount of cooling action to take place within the confined space adjacent the coil assemblies 134.

The plurality of apertures within the hammerbank 18 include a first plurality of apertures 282 and a second plurality of apertures 284. The first plurality of apertures 282 are shown in FIG. 3 as well as in FIG. 13. Each of the first plurality of apertures 282 which are generally equally spaced along the length of the hammerbank 18 extends generally vertically between the bottom surface 254 of the hammerbank 18 and a generally horizontal surface 286 at the bottom of a first plenum 288. The second plurality of apertures 284 extend generally horizontally into the hammerbank 18 from the back surface 256 as is shown in FIG. 4. Like the first plurality of apertures 282 the second plurality of apertures 284 are also generally equally spaced along the length of the hammerbank 18. As best seen in FIG. 13, each of the second plurality of apertures 284 extends from the back surface 256 through a back wall 290 of the hammerbank 18 and into a second plenum 292 formed by an internal cavity extending along the length of the hammerbank 18. The aperture 284 continues in a horizontal direction from the back wall 290 through the second plenum 292 and through a wall 294 to a generally vertical surface 296 at the first plenum 288.

FIG. 14 depicts a small portion of the first plenum 288 including the horizontal surface 286 and the vertical surface 296 which intersect at the bottom of the first plenum 288. FIG. 14 shows four of the first plurality of apertures 282 which are generally vertically disposed and which terminate at the horizontal surface 286. FIG. 14 also shows four of the second plurality of apertures 284 which extend horizontally and which terminate at the vertical surface 296. As shown in FIG. 14 the first and second pluralities of apertures 282 and 284 alternate in their positions along the length of the first plenum 288 so as to be staggered relative to each other along the length of the hammerbank 18.

As shown in FIG. 13 the elongated cavity 272 between the hammerbank 18 and the shuttle base 26 forms an air plenum which is common to both the first plurality of apertures 282 and the second plurality of apertures 284. In the present example, air is introduced into the common plenum formed by the elongated cavity 272 at a pressure of approximately 1.8 inches of water. This provides an air flow of approximately 30 cubic feet per minute into the common plenum and through the apertures 282 and 284 in the hammerbank 18. As shown by arrows in FIG. 13, the pressurized air entering the common plenum formed by the cavity 272 divides with part of the air flowing into the first plurality of apertures 282 and the remainder of the air flowing into the second plurality of apertures 284. Air entering the first plurality of apertures 282 flows upwardly therethrough and out of the apertures 282 at the horizontal surface 286 as shown in FIG. 14. Air entering the second plurality of apertures 284 flows through the back wall 290 and into the second plenum 292. From the second plenum 292 the air flows through the continuation of the second plurality of apertures 284 within the wall 294. Such air then exits the second plurality of apertures 284 at the vertical surface 296 as shown in FIG. 14.

The configuration of the first and second pluralities of apertures 282 and 284 increases the velocity of the pressurized air as it passes from the common plenum formed by the cavity 272 to the first plenum 288. Such configuration also combines with the staggering of the two sets of apertures 282 and 284 to create considerable turbulence in the air entering the first plenum 288. As shown in FIG. 14, the air from the second plurality of apertures 284 which is horizontally introduced into the first plenum 288 after swirling around the second plenum 292 mixes with the staggered vertical jets of air from the first plurality of apertures 282 in a highly turbulent manner. The result is that the first plenum 288 is filled with very turbulent air moving at high velocity, and this has been found to greatly enhance the cooling effect of the air.

The turbulent, high velocity air within the first plenum 288 rises upwardly to the coil assemblies 134 where it passes around and over the first and second magnetic coils 136 and 138 of each coil assembly 134. In spite of the relatively close spacing of the coil assemblies 134 and the considerable amount of heat generated thereby, the turbulent, high velocity air within the first plenum 288 has been found to provide more than adequate cooling of the coil assemblies 134 without the need for finned structures or other cumbersome devices.

The first plenum 288 which has the horizontal surface 286 at the bottom thereof is bounded on one side by the vertical surface 296. The side of the first plenum 288 opposite the vertical surface 296 is partly comprised of the free upper ends of the hammer springs 116 in the region of the coil assemblies 134 where the free upper ends of the hammer springs 116 normally reside in the retracted position against the pole pieces 126 and 128. The hammer springs 116 are separated by relatively small spaces. To prevent the turbulent, high velocity air in the first plenum 288 from escaping through the spaces between the hammer springs 116 instead of passing over the coil assemblies 134, an air dam is provided. The air dam is formed by large flanges on the bobbins holding the first and second magnetic coils 136 and 138 of each coil assembly 134. This is best shown in FIGS. 20 and 21 which depict one of the coil assemblies 134.

Figure 20:
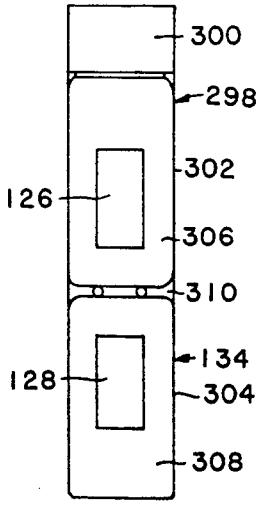
FIG. 20 is a front view of a magnetic coil assembly forming part of one of the magnetic hammer actuators and having bobbin flanges configured to form an air dam in accordance with the improved air cooling system.
Figure 21:
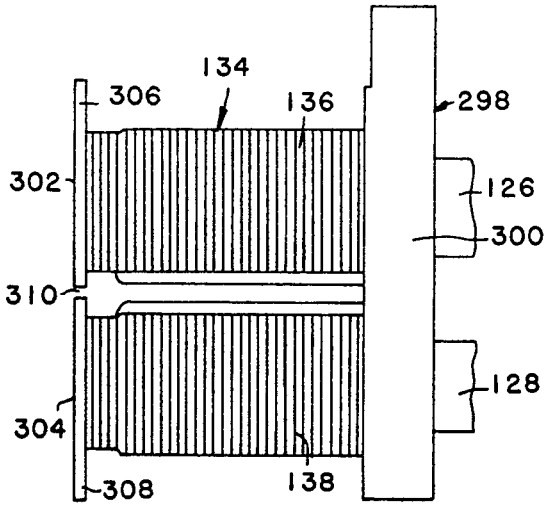
FIG. 21 is a side view of the magnetic coil assembly of FIG. 20.

As shown in FIGS. 20 and 21 the coil assembly 134 includes the first and second magnetic coils 136 and 138 mounted on a bobbin assembly 298. The bobbin assembly 298 includes a base 300 thereof which is mounted on the hammerbank 18 immediately outside of the groove 130. The bobbin assembly 298 includes first and second bobbins 302 and 304 which extend outwardly from the base 300 and which respectively mount the first and second magnetic coils 136 and 138 thereon. The bobbins 302 and 304 have hollow interiors configured to receive the forward portions of the pole pieces 126 and 128 therein. The first bobbin 302 termintes in a flange 306 at an outer end thereof adjacent the tip of the first pole piece 126. In like fashion, the second bobbin 304 terminates in a flange 308 at an outer end thereof adjacent the tip of the second pole piece 128.

The bobbin flanges 306 and 308 are disposed in close juxtaposition to each other as represented by a small interface 310 therebetween. Also, because of the relatively close spacing of the pairs of pole pieces 126 and 128 along the length of the groove 130, the bobbin assemblies 298 thereof are disposed relatively close to one another so that the flanges 306 and 308 thereof extend into close juxtaposition with the flanges 306 and 308 of the adjacent bobbin assemblies 298 on the opposite sides thereof. Thus, in addition to the flanges 306 and 308 of each bobbin assembly 298 combining to form an almost continuous wall at the outer ends of the magnetic coils 136 and 138, the flanges 306 at the outer ends of the various pole pieces 126 form an almost continuous wall along the length of the groove 130 at the outer ends of the magnetic coils 136. In similar fashion the flanges 308 at the outer ends of the pole pieces 128 form an almost continuous wall along the length of the groove 130 at the outer ends of the magnetic coils 138. The resulting wall or air dam is highly effective in preventing significant amounts of the turbulent, high velocity air in the first plenum 288 from escaping through the spaces between the adjacent hammer springs 116. The air dam forces practically all of the air to pass over the magnetic coils 136 and 138 of each coil assembly 134. Following that, the air passes directly upwardly and out of the shuttle assembly 10 as shown by arrows at the top of FIG. 13.

As shown in FIG. 13, the hammerbank 18 is comprised of two different elongated members 312 and 314 which extend along the entire length of the hammerbank 18 in conjunction with the shaft 82. The first elongated member 312 forms the front portion 253 of the hammerbank 18. The lower part of the elongated member 312 forms the hammer spring mounting surface 118 and the first plenum 288. The opposite upper part of the first elongated member 312 has the groove 130 therein for receiving the pole pieces 126 and 128 and the permanent magnets 132 and terminates at the top portion 261 of the hammerbank 18. A portion of the bottom part of the elongated member 312 opposite the hammer spring mounting surface 118 is configured to receive a circumferential portion of the shaft 82 along the length thereof. The second elongated member 314 is joined to the first elongated member 312 at lower and upper parts thereof. The lower part of the second elongated member 314 forms a substantial portion of the bottom surface 254 as well as all of the back surface 256 and the angled lower surface 258 of the hammerbank 18. The lower part of the second elongated member 314 is configured to receive a circumferential portion of the shaft 82 along the length thereof. A portion of the second elongated member 314 is spaced apart from the first elongated member 312 so as to form the second plenum 292 together with the first elongated member 312 at a circumferential portion of the shaft 82.

As previously noted, each of the hammer springs 116 is held in the retracted position against, and is selectively released or fired from, an associated magnetic hammer actuator which includes the two pole pieces 126 and 128, the permanent magnet 132 and the coil assembly 134 including the first and second magnetic coils 136 and 138. In spite of the close proximity of adjacent magnetic hammer actuators provided by the compact configuration of the hammerbank 18, magnetic interaction therebetween is greatly minimized by a number of the features of the hammerbank 18. One such feature resides in the fact that with the exception of the permanent magnet 132, there are no magnetic materials extending between and therefore common to two or more of the magnetic hammer actuators. The elongated member 312 of the hammerbank 18 which includes the groove 130 therein is of non-magnetic material, being aluminum in the present example. The second elongated member 314 of the hammerbank 18 is also made of aluminum, as is the shaft 82. The only magnetic element extending between adjacent magnetic hammer actuators is the permanent magnet 132 which carries little or no leakage flux between adjacent magnetic hammer actuators.

In the present example, a different permanent magnet 132 is associated with each different group of four of the magnetic hammer actuators. The various permanent magnets 132 are disposed end-to-end to form a generally continuous permanent magnet structure along the length of the groove 130. FIG. 16 shows one of the permanent magnets 132 together with the pole pieces of the four magnetic hammer actuators associated therewith. The permanent magnet 132 is of elongated, generally rectangular configuration and is disposed between rear portions 316 and 318 of each pair of pole pieces 126 and 128. The rear portions 316 and 318 of the pole pieces 126 and 128 and the permanent magnet 132 which is disposed therebetween are mounted within the groove 130 using epoxy or other appropriate non-magnetic adhesive. Each pair of pole pieces 126 and 128 has forward portions 320 and 322 thereof which extend out of the groove 130 and which receive the magnetic coils 136 and 138 of a different coil assembly 134 thereon as previously described.

FIG. 17 is a front view of the permanent magnet 132 and the four pairs of pole pieces 126 and 128 associated therewith. It is highly advantageous to have the permanent magnet 132 extending through the space between each adjacent pair of the pole pieces 126 and 128. In the absence of the permanent magnet 132 between adjacent pairs of pole pieces, considerable leakage flux has been found to occur between the upper pole pieces 126 and the lower pole pieces 128. With the permanent magnet 132 extending through and therefore present within the spaces between adjacent pairs of the pole pieces 126 and 128, however, it has been found that leakage flux between the upper pole pieces 126 and the lower pole pieces 128 is greatly minimized. As shown in FIG. 17, lines representing leakage flux extend from the first and second pole pieces 126 and 128 to the permanent magnet 132 where they terminate.

By using only non-magnetic materials between the various magnetic hammer actuators, with the exception of the permanent magnets 132, and by extending the permanent magnets 132 between the adjacent pairs of the pole pieces in the various different magnetic hammer actuators, undesirable magnetic interaction between adjacent magnetic hammer actuators has been found to be greatly minimized. In the present example, such interaction has been found to be as little as one part in ten thousand or even less.

Figure 18:
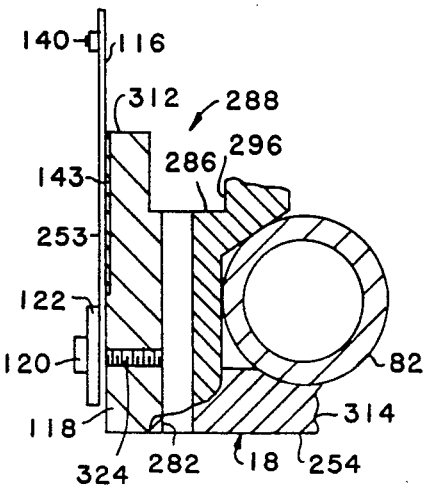
FIG. 18 is a sectional view of a portion of the hammerbank of FIG. 1 illustrating an improved hammer spring mounting screw hole arrangement in accordance with the invention.

FIG. 18 is a sectional view of a portion of the hammerbank 18 which shows the hammer spring mounting surface 118 in conjunction with a hammer spring 116, the screw 120 and the mounting plate 122. As previously described in connection with FIG. 3, the lower end of each hammer spring 116 is secured to the mounting surface 118 by a different one of the screws 120 which extends through the mounting plate 122, the lower end of the hammer spring 116 and into the hammerbank 18. A different one of the mounting plates 122 is used to mount each pair of the hammer springs 116.

The screw 120 for mounting the hammer spring 116 extends into a screw hole 324 in the hammerbank 18 as shown in FIG. 18. The screw hole 324, which has an end thereof at the hammer spring mounting surface 118, is endless in that an opposite end thereof opens into one of the first plurality of apertures 282 in the hammerbank 18. The hammerbank 18 has sixty six of the screw holes 324 spaced along the length thereof at the hammer spring mounting surface 118 to mount the sixty six hammer springs 116. There are a sufficient number of the first plurality of apertures 282 spaced along the length of the hammerbank 18 so that each screw hole 324 terminates at one of the first plurality of apertures 282.

The screw holes 324 in the hammerbank 18 provide several advantages. For one thing, the screw holes 324 are relatively long in that they extend from the hammer spring mounting surface 118 all the way to one of the first plurality of apertures 282. This enables the hammer spring mounting screws 122 to be relatively long, providing for better and more secure mounting of the hammer springs 116. Moreover, the screw 120 can extend completely through the screw hole 324 and into the adjoining one of the first plurality of apertures 282 if necessary. The endless configurations of the screw holes 324 provides a further advantage in eliminating dirt and other debris. Where the hammer mounting screw is driven into a screw hole having an end thereto, oil residue and other debris become trapped between the end of the screw and the end of the screw hole where the debris remains. In the configuration shown in FIG. 18, however, the open end of the screw hole 324 at the adjoining one of the first plurality of apertures 282 enable such debris to be expelled into the aperture 282.

As previously described in connection with FIG. 3, a plurality of magnetic clip assemblies 104 are mounted on the hammerbank 18 to hold the upper portions of the cover assembly 78 in fixed relation relative to the hammerbank 18. One of the magnetic clip assemblies 104 is shown in detail in FIG. 19. As shown therein, the magnetic clip assembly 104 includes a pair of pins 326 and 328 secured to the top portion 261 of the hammerbank 18 at a different portion of the length of the hammerbank 18 so as to extend outwardly therefrom in spaced-apart, generally parallel fashion. An elongated base clip 330 extends between and has opposite ends 332 and 334 thereof secured to outer ends 336 and 338 of the pins 326 and 328 respectively. Each of the ends 332 and 334 of the base clip 330 partly encircles an associated one of the outer ends 336 and 338 of the pins 326 and 328 and is secured thereto by welding. A permanent magnet 340 is mounted on an intermediate portion 342 of the base clip 320 between the opposite ends 332 and 334 of the base clip 330. The permanent magnet 340 is secured to the intermediate portion 342 of the base clip 330 by three different rivets 344 which extend through a top clip 346, the permanent magnet 340 and the intermediate portion 342.

Following installation of the pins 326 and 328 in the top portion 261 of the hammerbank 18 and assembly of the remainder of the magnetic clip assembly 104 as shown, the various magnetic clip assemblies 104 spaced along the length of the hammerbank 18 at the top portion 261 thereof are ground as necessary so that each clip assembly 104 provides a reference surface 348 at a desired location relative to the top portion 261 of the hammerbank 18. The reference surface 348 which is comprised of the outer ends of the pins 326 and 328, an edge of the base clip 330, a side edge of the permanent magnet 340 and an edge of the top clip 346, receives the upper edge 102 of the cover assembly 78 and holds the upper 102 of the cover assembly in the desired position relative to the hammerbank 18 as defined by the reference surface 348.

In the present example, six of the magnetic clip assemblies 104 are spaced along the length of the top portion 261 of the hammerbank 18. One of the magnetic clip assemblies 104 is shown in the sectional view of FIG. 13. Also in the present example, the permanent magnet 340 consists of a magnetizable rubber magnet. Following assembly of the magnetic clip assembly 104 and grinding thereof, the rubber magnet is then magnetized to form the permanent magnet 340.

While there have been described above and illustrated in the drawings a number of variations, modifications and alternative forms, it will be appreciated that the scope of the invention defined by the appendant claims includes all forms comprehended thereby.

What is claimed:

1. A printer comprising the combination of:

an elongated frame structure mounted within the printer and having an elongated cavity therein:

an elongated hammerbank mounted within the elongated cavity of the frame structure and capable of undergoing reciprocating motion therein, the hammerbank including a plurality of magnetic coils mounted along the length thereof:

a source of pressurized air; and means coupling the source of pressurized air to the elongated cavity of the frame structure to introduce pressurized air into the cavity;

the elongated hammerbank further including a plurality of apertures in the hammerbank for directing pressurized air from the cavity over the plurality of coils, each of the apertures having one end thereof within the cavity and an opposite end thereof adjacent the plurality of coils, the elongated hammerbank having an elongated bottom surface extending along the length thereof and an elongated back surface extending along the length thereof and the plurality of apertures including a first plurality of apertures spaced part along the length of the hammerbank and each of said apertures lying within a first plane and extending between the elongated bottom surface within a first region of the cavity and the region adjacent the plurality of coils in a first common direction, and a second plurality of apertures spaced apart along the length of the hammerbank and each of said apertures lying within a second plane extending between the elongated back surface within a second region of the cavity and the region adjacent the plurality of coils in a second common direction different from the first common direction, the first plane intersecting the second plane adjacent the plurality of coils whereby pressurized air form the first and second pluralities of apertures comes together and mixes adjacent the plurality of coils.

2. A printer comprising the combination of:

an elongated frame structure mounted within the printer and having an elongated cavity therein;

an elongated hammerbank mounted within the elongated cavity of the frame structure and capable of undergoing reciprocating motion therein, the hammerbank including a plurality of magnetic coils mounted along the length thereof;

a source of pressurized air; and means coupling the source of pressurized air to the elongated cavity of the frame structure to introduce pressurized air into the cavity;

the elongated hammerbank further including a plurality of apertures in the hammerbank for directing pressurized air from the cavity over the plurality of coils, each of the apertures having one end thereof within the cavity and an opposite end thereof adjacent the plurality of coils, the elongated hammerbank having an elongated bottom surface extending along the length thereof and an elongated back surface extending along the length thereof and the plurality of apertures including a first plurality of apertures spaced apart along the length of the hammerbank and each of said apertures extending between the elongated bottom surface within a first region of the cavity and the region adjacent the plurality of coils in a first common direction, and a second plurality of apertures spaced apart along the length of the hammerbank and each of said apertures extending between the elongated back surface within a second region of the cavity and the region adjacent the plurality of coils in a second common direction different from the first common direction; the second plurality of apertures being staggered relative to the first plurality of apertures so as to alternate with the first plurality of apertures along the length of the hammerbank, the bottom surface being perpendicular to the back surface and the second common direction being perpendicular to the first common direction.

3. A printer comprising the combination of:

an elongated frame structure mounted within the printer and having an elongated cavity therein;

an elongated hammerbank mounted within the elongated cavity of the frame structure and capable of undergoing reciprocating motion therein, the hammerbank including a plurality of magnetic coils mounted along the length thereof;

a source of pressurized air; and means coupling the source of pressurized air to the elongated cavity of the frame structure to introduce pressurized air into the cavity;

the elongated hammerbank further including a plurality of apertures in the hammerbank for directing pressurized air from the cavity over the plurality of coils, each of the apertures having one end thereof within the cavity and an opposite end thereof adjacent the plurality of coils; the elongated hammerbank having an elongated bottom surface extending along the length thereof and an elongated back surface extending along the length thereof and the plurality of apertures including a first plurality of apertures spaced apart along the length of the hammerbank and extending between the elongated bottom surface with a first region of the cavity and the region adjacent the plurality of coils, and a second plurality of apertures spaced apart along the length of the hammerbank and extending between the elongated back surface within a second region of the cavity and the region adjacent the plurality of coils;

the cavity defining a common plenum for pressurized air introduced therein by the means coupling the source of pressurized air to the elongated cavity, the region adjacent the plurality of coils defining a first plenum extending along a substantial portion of the length of the hammerbank, and the hammerbank having an elongated cavity therein extending along a substantial portion of the length of the hammerbank and defining a second plenum, the second plurality of apertures extending from the common plenum through the second plenum to the first plenum.

4. A printer comprising the combination of:

an elongated shuttle base having an elongated chamber therein and an elongated aperture arrangement in a bottom thereof extending into the chamber;

an elongated base support member having the shuttle base mounted thereon along the length thereof and having an elongated aperture arrangement extending therethrough in communication with the elongated aperture arrangement in the bottom of the shuttle base;

means for introducing pressurized air into the elongated aperture arrangement extending through the base support member;

the elongated aperture arrangement extending through the base support member comprising means for conveying the pressurized air introduced therein to the shuttle base;

the elongated aperture arrangement in the bottom of the shuttle base comprising means for conveying pressurized air from the base support member to the shuttle base; and an elongated hammerbank mounted to undergo reciprocating movement within the chamber in the shuttle base, and including means for conveying pressurized air from the shuttle base into the chamber and to a region of the hammerbank to be cooled.

5. The invention set forth in claim 4, wherein the means for introducing air into the elongated aperture arrangement extending through the base support member includes an elongated air chamber mounted on the bottom of the base support member and having a hollow interior in communication with the elongated aperture arrangement in the shuttle base through an elongated opening therein, a duct coupled to the hollow interior of the air chamber and a blower coupled to the duct.

6. The invention set forth in claim 4, wherein the elongated aperture arrangement in the bottom of the shuttle base is comprised of a plurality of apertures in the bottom thereof located along the length of the shuttle base and extending into different portions of the length of the chamber, and the means for introducing pressurized air into the chamber in the shuttle base introduces pressurized air into each of the plurality of apertures in the bottom of the shuttle base.

7. A printer comprising the combination of:

an elongated shuttle base having an elongated chamber therein and an elongated aperture arrangement in a bottom thereof extending into the chamber;

an elongated base support member having the shuttle base mounted thereon along the length thereof and having an elongated aperture arrangement extending therethrough in communication with the elongated aperture arrangement in the bottom of the shuttle base;

means for introducing pressurized air into the elongated aperture arrangement extending through the base support member; and an elongated hammerbank mounted to undergo reciprocating movement within the chamber int he shuttle base, and including means for conveying pressurized air introduced into the chamber to a region of the hammerbank to be cooled;

the chamber extending upwardly to a top of the shuttle base and being covered with an elongated shuttle shroud, the elongated shuttle shroud being mounted on the shuttle base and extending into a region adjacent an upper portion of the hammerbank.

8. The invention set forth in claim 7, further including an elongated strip of flexible material coupled to the shuttle shroud along the length of the shuttle shroud and extending into contact with the upper portion of the hammerbank.

9. A printer comprising the combination of:

an elongated shuttle base having an elongated chamber therein and an elongated aperture arrangement in a bottom thereof extending into the chamber;

an elongated base support member having the shuttle base mounted thereon along the length thereof and having an elongated aperture arrangement extending therethrough in communication with the elongated aperture arrangement in the bottom of the shuttle base;

means for introducing pressurized air into the elongated aperture arrangement extending through the base support member;

an elongated hammerbank mounted to undergo reciprocating movement within the chamber in the shuttle base, and including means for conveying pressurized air introduced into the chamber to a region of the hammerbank to be cooled; and a pair of end seals mounted in the chamber, each of the end seals extending into contact with a different one of opposite ends of the hammerbank to seal the chamber at the opposite ends of the hammerbank.

10. The invention as set forth in claim 9, wherein the shuttle base forms an opening in the chamber with a lower portion of the hammerbank along the length of the chamber, and further including a strip of flexible material mounted on the shuttle base along the length of the chamber and extending into a location adjacent the lower portion of the hammerbank to seal the opening in the chamber.

11. An elongated hammerbank for use in a printer in which pressurized cooling air is introduced to the hammerbank, the hammerbank including a plurality of hammer springs mounted along the length of the hammerbank at the bases of the hammer springs and having opposite upper ends, the hammerbank having a recessed portion along the length thereof adjacent the upper ends of the plurality of hammer springs defining a plenum, a plurality of magnetic coil assemblies mounted on the hammerbank along the length thereof and extending to the upper ends of the plurality of hammer springs within the plenum of the hammerbank, and a plurality of apertures in the hammerbank spaced along the length of the hammerbank, each of the apertures extending through the hammerbank from a lower region of the hammerbank to a surface of the plenum below the plurality of coil assemblies to carry pressurized cooling air introduced at the lower region of the hammerbank to the plenum below the plurality of coil assemblies, the plurality of apertures being comprised of a first plurality of apertures spaced along the length of the hammerbank and each lying within a first plane and extending in a first common direction and a second plurality of apertures spaced along the length of the hammerbank and each lying within a second plane and extending in a second common direction which is different from the first common direction, the first plane intersecting the second plane within the plenum whereby pressurized cooling air from the first and second pluralities of apertures comes together and mixes within the plenum adjacent the plurality of magnetic coil assemblies.

12. The invention set forth in claim 11, wherein each of the plurality of magnetic coil assemblies includes at least one coil extending from the hammerbank within the plenum and terminating in a bobbin flange at an outer end thereof adjacent the upper ends of the plurality of hammer springs, the bobbin flanges of the plurality of magnetic coil assemblies being generally vertically disposed and forming an air dam in the region of the upper ends of the plurality of hammer springs.

13. The invention set forth in claim 11, wherein each of the first plurality of apertures extends generally vertically between the lower region of the hammerbank and the plenum of the hammerbank and each of the second plurality of apertures extends generally horizontally between an upper portion of the lower region of the hammerbank and the plenum of the hammerbank.

14. An elongated hammerbank for use in a printer in which pressurized cooling air is introduced to the hammerbank, the hammerbank including a plurality of hammer springs mounted along the length of the hammerbank at the bases of the hammer springs and having opposite upper ends, the hammerbank having a recessed portion along the length thereof adjacent the upper ends of the plurality of hammer springs, a plurality of magnetic coil assemblies mounted on the hammerbank along the length thereof and extending to the upper ends of the plurality of hammer springs within the recessed portion of the hammerbank, and a plurality of apertures in the hammerbank spaced along the length of the hammerbank, each of the apertures extending through the hammerbank from a lower region of the hammerbank to the recessed portion below the plurality of coil assemblies to carry pressurized cooling air introduced at the lower region of the hammerbank to the recessed portion below the plurality of coil assemblies, the plurality of apertures including a first plurality of apertures spaced along the length of the hammerbank and extending generally vertically between the lower region of the hammerbank and the recessed portion of the hammerbank and a second plurality of apertures spaced along the length of the hammerbank and extending generally horizontally between an upper portion of the lower region of the hammerbank and the recessed portion of the hammerbank, the hammerbank having a plurality of screw holes therein, each of the screw holes extending between an outer surface of the hammerbank and one of the first plurality of apertures and receiving a screw therein to mount one of the plurality of hammer springs on the hammerbank.

15. An elongated hammerbank for use in a printer in which pressurized cooling air is introduced to the hammerbank, the hammerbank including a plurality of hammer springs mounted along the length of the hammerbank at the bases of the hammer springs and having opposite upper ends, the hammerbank having a recessed portion along the length thereof adjacent the upper ends of the plurality of hammer springs, a plurality of magnetic coil assemblies mounted on the hammerbank along the length thereof and extending to the upper ends of the plurality of hammer springs within the recessed portion of the hammerbank, and a plurality of apertures in the hammerbank spaced along the length of the hammerbank, each of the apertures extending through the hammerbank from a lower region of the hammerbank to the recessed portion below the plurality of coil assemblies to carry pressurized cooling air introduced at the lower region of the hammerbank to the recessed portion below the plurality of coil assemblies, the plurality of apertures including a first plurality of apertures spaced along the length of the hammerbank and extending generally vertically between the lower region of the hammerbank and the recessed portion of the hammerbank and a second plurality of apertures spaced along the length of the hammerbank and extending generally horizontally between an upper portion of the lower region of the hammerbank and the recessed portion of the hammerbank, the recessed portion of the hammerbank having a generally horizontal surface at a bottom thereof at which the first plurality of apertures terminate and an adjoining generally vertical surface at which the second plurality of apertures terminate.

16. The invention set forth in claim 13, wherein the apertures of the first and second pluralities of apertures alternate in occurrence along the length of the hammerbank so as to be staggered relative to each other.

17. An elongated hammerbank for use in a printer in which pressurized cooling air is introduced to the hammerbank, the hammerbank including a plurality of hammer springs mounted along the length of the hammerbank at the bases of the hammer springs and having opposite upper ends, the hammerbank having a recessed portion along the length thereof adjacent the upper ends of the plurality of hammer springs, a plurality of magnetic coil assemblies mounted on the hammerbank along the length thereof and extending to the upper ends of the plurality of hammer springs within the recessed portion of the hammerbank, and a plurality of apertures in the hammerbank spaced along the length of the hammerbank, each of the apertures extending through the hammerbank from a lower region of the hammerbank to the recessed portion below the plurality of coil assemblies to carry pressurized cooling air introduced at the lower region of the hammerbank to the recessed portion below the plurality of coil assemblies, the plurality of apertures including a first plurality of apertures spaced along the length of the hammerbank and extending generally vertically between the lower region of the hammerbank and the recessed portion of the hammerbank and a second plurality of apertures spaced along the length of the hammerbank and extending generally horizontally between an upper portion of the lower region of the hammerbank and the recessed portion of the hammerbank, the hammerbank having an elongated chamber therein extending along the length of the hammerbank and disposed between the upper portion of the lower region of the hammerbank and the recessed portion, and each of the second plurality of apertures extending from the upper portion of the lower region of the hammerbank through the elongated chamber to the recessed portion.

18. A hammerbank for use in a printer comprising the combination of:

an elongated frame having a hammer spring mounting surface extending along the length of the frame, a plurality of apertures in the frame spaced along the length of the frame, and a plurality of screw holes in the frame spaced along the length of the frame and each extending between the hammer spring mounting surface and one of the plurality of apertures; and a plurality of hammer springs mounted on the frame along the hammer spring mounting surface, each of the hammer springs being mounted by a screw extending through the hammer spring and into a different one of the screw holes.

19. The invention set forth in claim 18, wherein the plurality of apertures are generally vertically disposed and are operative to draw pressurized air from outside the frame therethrough to an opposite region of the frame.

20. In a hammerbank in which cooling air is introduced into a region adjacent a plurality of coils coupled to the hammerbank, the region extending upwardly between the hammerbank and a plurality of hammer springs mounted on the hammerbank to the coils, the improvement comprising a plurality of bobbin flanges at ends of the coils adjacent the hammer springs, the bobbin flanges being generally vertically disposed and extending outwardly from the coils and into close juxtaposition with each other to form a generally vertical air dam, and means for introducing cooling air under pressure into the region at one side of the air dam, the introduced cooling air passing upwardly between the hammer springs and the hammerbank and over the coils.

21. The invention set forth in claim 20, wherein the coils are mounted on pole pieces that are generally horizontally disposed so as to extend outwardly from the hammerbank in pairs and are spaced-apart from adjacent paris of pole pieces along the length of the hammerbank to form first and second rows of spaced-apart pole pieces along the length of the hammerbank with first and second rows of coils mounted thereon, the bobbin flanges of each of the first and second rows of coils extending into close juxtaposition with bobbin flanges of adjacent coils on opposite sides thereof in the same row and into close juxtaposition with the bobbin flanges of opposite coils in the other row.

* * * * *